US009228742B2

(12) United States Patent
Akiyama et al.

(10) Patent No.: US 9,228,742 B2
(45) Date of Patent: Jan. 5, 2016

(54) RICH-LEAN COMBUSTION BURNER AND COMBUSTION APPARATUS

(71) Applicant: NORITZ CORPORATION, Hyogo (JP)

(72) Inventors: Takashi Akiyama, Hyogo (JP); Takeshi Wakada, Hyogo (JP); Toshio Watanabe, Hyogo (JP); Itsuo Nagai, Hyogo (JP); Yasutaka Kuriyama, Hyogo (JP); Norihide Wada, Hyogo (JP); Ryosuke Umakoshi, Hyogo (JP); Keigo Fukunishi, Hyogo (JP)

(73) Assignee: Noritz Corporation (JP)

( * ) Notice: Subject to any disclaimer, the term of this patent is extended or adjusted under 35 U.S.C. 154(b) by 353 days.

(21) Appl. No.: 13/727,136

(22) Filed: Dec. 26, 2012

(65) Prior Publication Data

US 2013/0171576 A1 Jul. 4, 2013

(30) Foreign Application Priority Data

Dec. 28, 2011 (JP) ..... 2011-287440
Feb. 29, 2012 (JP) ..... 2012-042866

(51) Int. Cl.
*F23D 14/58* (2006.01)
*F23D 14/02* (2006.01)
*F23D 14/10* (2006.01)

(52) U.S. Cl.
CPC ..... *F23D 14/02* (2013.01); *F23D 14/105* (2013.01); *F23D 14/58* (2013.01); *F23C 2201/20* (2013.01); *F23D 2213/00* (2013.01)

(58) Field of Classification Search
USPC ..... 239/533.2, 565, 590
See application file for complete search history.

(56) References Cited

U.S. PATENT DOCUMENTS 1,115,533 A * 11/1914 Hartwell ..... 239/525
2,470,880 A * 5/1949 Zimbelman et al. ..... 239/556
2,525,960 A * 10/1950 Shaw ..... 239/423
2,541,710 A * 2/1951 Miller ..... 239/427.3
2,572,273 A * 10/1951 Miller et al. ..... 239/553.3

(Continued)

FOREIGN PATENT DOCUMENTS

JP 07-042913 A 2/1995
JP 07-042917 A 2/1995

(Continued)

OTHER PUBLICATIONS

Office Action issued in Japanese Application No. 2012-042866, dated Aug. 28, 2014.

*Primary Examiner* — Gregory Huson
*Assistant Examiner* — Martha Becton
(74) *Attorney, Agent, or Firm* — Fishman Stewart Yamaguchi PLLC

(57) ABSTRACT

There is provided a flame hole formation member 7 which is inserted and mounted from above in a third plate member 6 used to form a central rich-side flame hole row 33. As the flame hole formation member 7, a pair of flame hole formation parts 71, 71 each used to form a respective lean-side flame hole row 34 are connected by bridge formation parts 72, 72 at their upper end positions, with a predetermined distance held between the flame hole formation parts 71, 71. The bridge formation part 72, 72 is fitted from above into an engagement groove 332 formed in the upper end edge of the third plate member 6, whereby the pair of the flame hole formation parts 71, 71 are assembled so as to sit astride the upper end edge of the third plate member 6.

11 Claims, 23 Drawing Sheets

(56) References Cited

U.S. PATENT DOCUMENTS

| | | | | | |
|---|---|---|---|---|---|
| D165,883 | S | * | 2/1952 | Solomon et al. | D23/415 |
| 2,746,799 | A | * | 5/1956 | Nelson | 239/279 |
| 2,828,532 | A | * | 4/1958 | Taylor | 29/890.02 |
| 2,940,517 | A | * | 6/1960 | Skellern | 239/289 |
| 3,047,056 | A | * | 7/1962 | Flynn | 239/552 |
| 3,215,186 | A | * | 11/1965 | Levitt | 431/126 |
| 3,512,910 | A | * | 5/1970 | Hein | 431/154 |
| 3,526,367 | A | * | 9/1970 | Trihey | 239/556 |
| 3,615,249 | A | * | 10/1971 | Martois | 422/183 |
| 3,708,126 | A | * | 1/1973 | De Kinkelder | 239/590.5 |
| 4,185,780 | A | * | 1/1980 | Duchene et al. | 239/553.5 |
| 4,222,526 | A | * | 9/1980 | Halstead | 239/556 |
| 4,417,868 | A | * | 11/1983 | Putnam | 431/1 |
| 4,940,406 | A | * | 7/1990 | Kee | 431/22 |
| 5,062,788 | A | * | 11/1991 | Best | 431/7 |
| 5,073,106 | A | * | 12/1991 | Toyonaga et al. | 431/285 |
| 5,099,879 | A | * | 3/1992 | Baird | 137/561 A |
| 5,318,438 | A | * | 6/1994 | Sugahara et al. | 431/285 |
| 5,368,476 | A | * | 11/1994 | Sugahara et al. | 431/285 |
| 5,525,054 | A | * | 6/1996 | Nakaura et al. | 431/285 |
| 5,833,449 | A | * | 11/1998 | Knight et al. | 431/191 |
| 5,860,411 | A | * | 1/1999 | Thompson et al. | 126/116 A |
| 6,000,934 | A | * | 12/1999 | Shavers et al. | 431/354 |
| RE36,743 | E | * | 6/2000 | Ripka | 431/353 |
| 6,363,967 | B1 | * | 4/2002 | Tanaka et al. | 137/597 |
| 6,564,795 | B1 | * | 5/2003 | Sears et al. | 126/110 R |
| 6,746,236 | B2 | * | 6/2004 | Kuriyama et al. | 431/354 |
| 6,918,759 | B2 | * | 7/2005 | Cho et al. | 431/354 |
| 6,960,077 | B2 | * | 11/2005 | Buccilli et al. | 431/354 |
| 7,137,568 | B1 | * | 11/2006 | LaCrosse | 239/1 |
| D672,869 | S | * | 12/2012 | Akiyama et al. | D23/415 |
| D681,801 | S | * | 5/2013 | Akiyama et al. | D23/415 |
| 9,091,436 | B2 | * | 7/2015 | Homma | 1/1 |
| 2003/0143507 | A1 | * | 7/2003 | Kuriyama et al. | 431/354 |
| 2012/0156629 | A1 | * | 6/2012 | Akiyama et al. | 431/354 |
| 2012/0219920 | A1 | * | 8/2012 | Akiyama et al. | 431/278 |
| 2012/0308945 | A1 | * | 12/2012 | Wada et al. | 431/278 |
| 2013/0149653 | A1 | * | 6/2013 | Fukunishi et al. | 431/278 |
| 2013/0171576 | A1 | * | 7/2013 | Akiyama et al. | 431/354 |
| 2013/0247844 | A1 | * | 9/2013 | Cheng et al. | 122/18.4 |

FOREIGN PATENT DOCUMENTS

| | | | |
|---|---|---|---|
| JP | 07-091620 | A | 4/1995 |
| JP | 07-127819 | A | 5/1995 |
| JP | 11-051328 | A | 2/1999 |
| JP | 2002-048312 | A | 2/2002 |
| JP | 2002-048314 | A | 2/2002 |
| JP | 2002-115817 | A | 4/2002 |
| JP | 2003-269705 | A | 9/2003 |
| JP | 2003-269707 | A | 9/2003 |
| JP | 2004-020136 | A | 1/2004 |
| JP | 2007-285536 | A | 11/2007 |

* cited by examiner

Fig. 1
Fig. 1 (a)
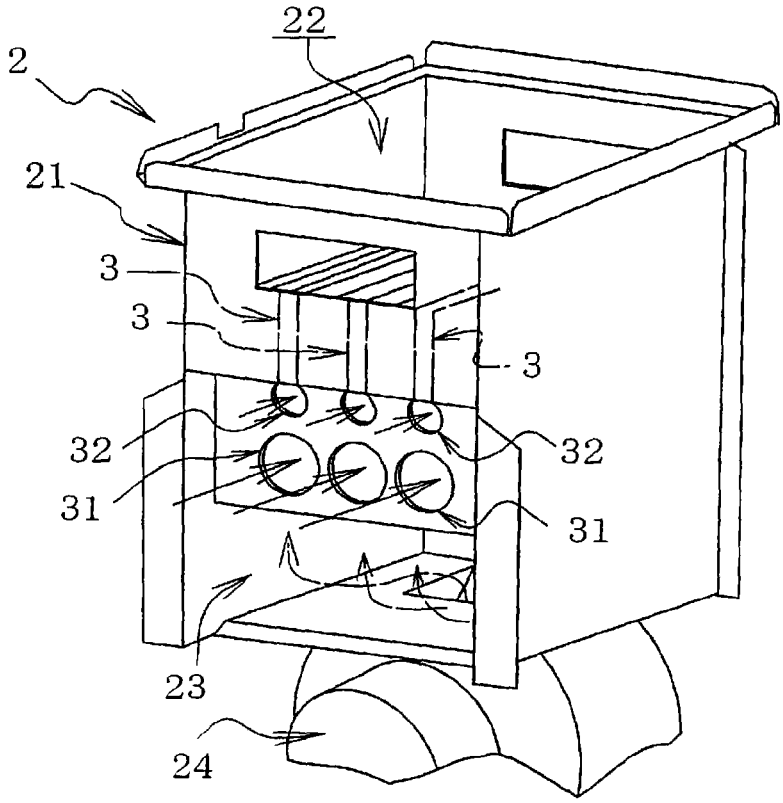
Fig. 1 (b)
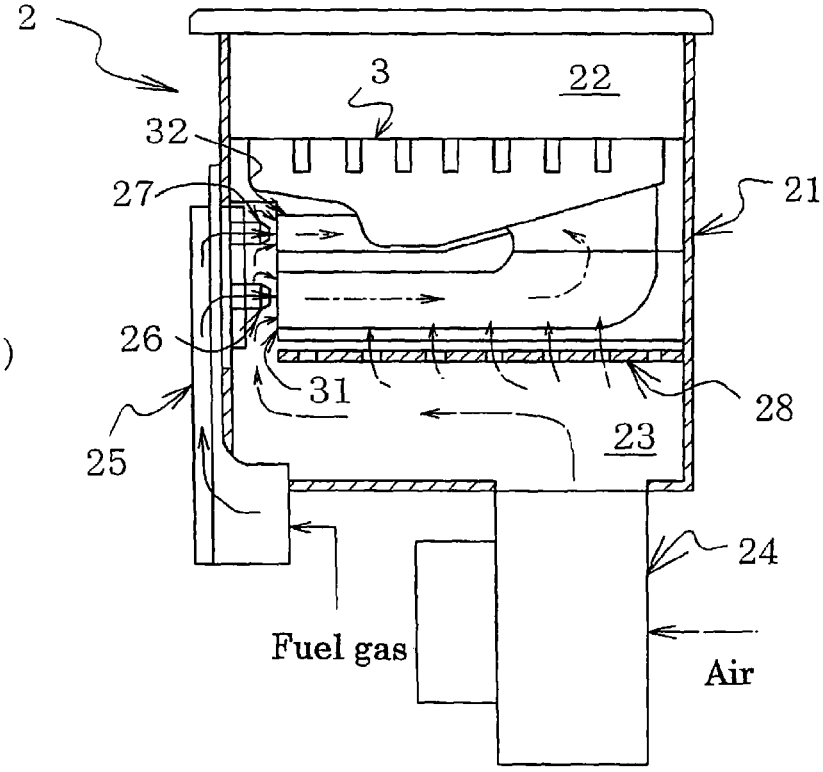

Fig. 3
Fig. 3 (a)
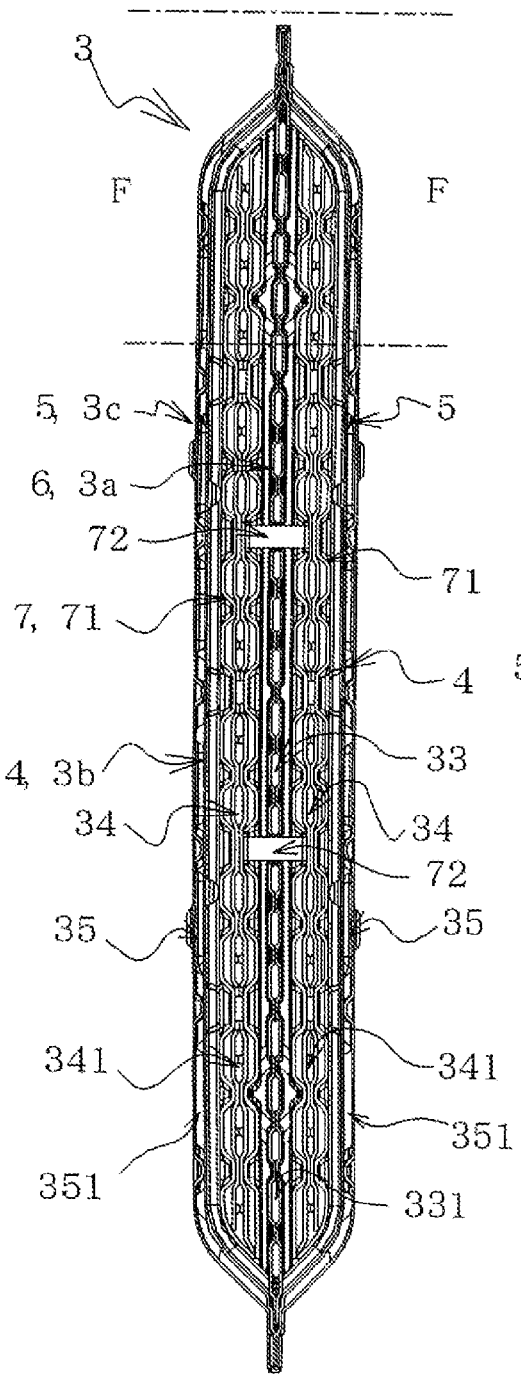
Fig. 3 (b)
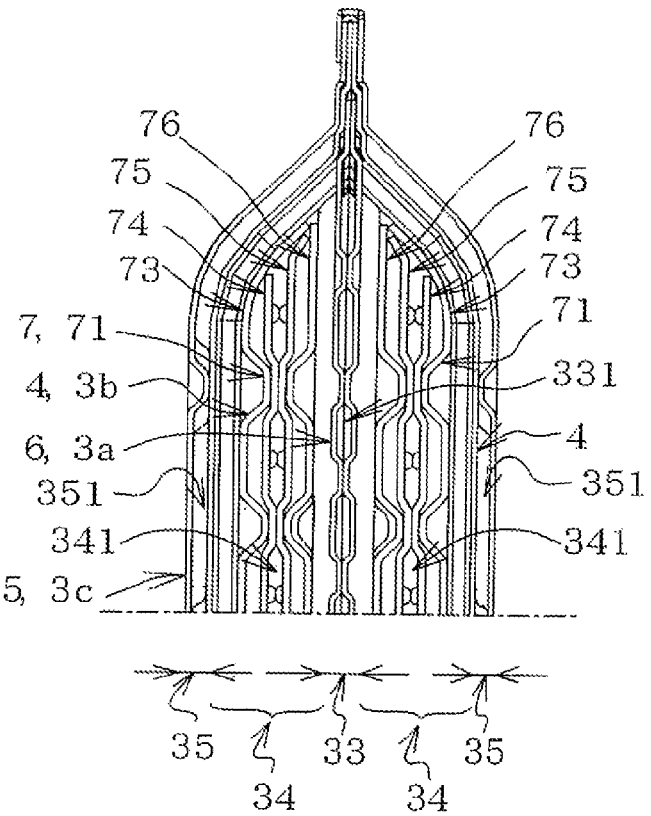

Fig. 17
Fig. 17 (a)
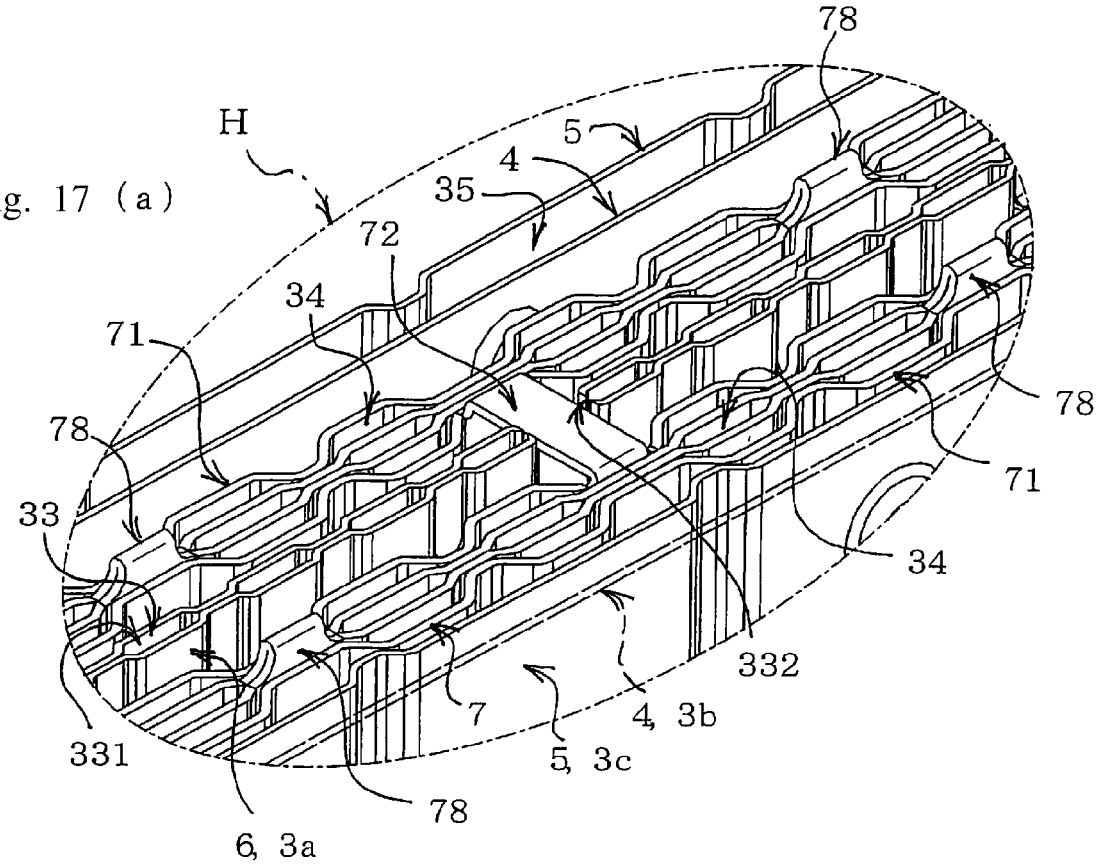
Fig. 17 (b)
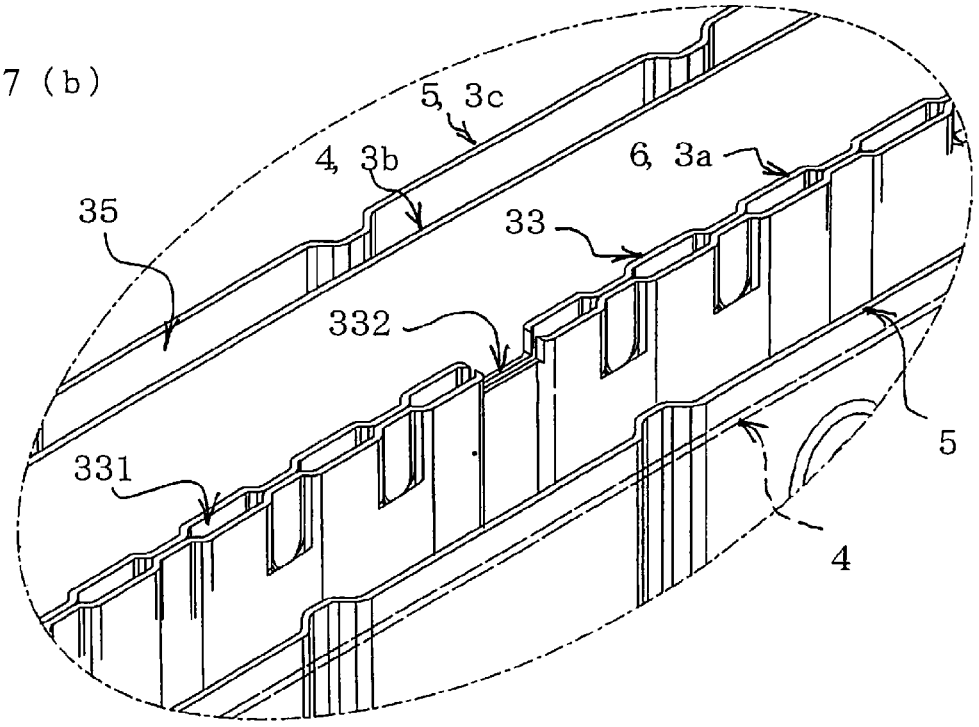

RICH-LEAN COMBUSTION BURNER AND COMBUSTION APPARATUS

TECHNICAL FIELD

The present invention relates to a rich-lean combustion burner which comprises rich-side flame holes and lean-side flame holes, and to a combustion apparatus which comprises such a rich-lean combustion burner. In particular with regard to a rich-lean combustion burner of the type that is formed by assembling various types of formation members so that lean-side flame holes are arrayed in two rows in opposing relation to each other across a row of central flame holes and rich-side flame holes are arrayed in two rows respectively outside the lean-side flame hole rows, the present invention is concerned with the technology for, while intending to provide facilitation and assurance of the assembly of a formation member used to form two rows of lean-side flame holes, enabling the formation member to be assembled accurately relative to different directions, i.e., the horizontal direction, the front-to-back direction and the vertical direction, in relative positional relation to the other formation members.

BACKGROUND ART

Heretofore, various types of rich-lean combustion burners have been proposed, which are characterized in that for reduction in $NO_x$, a lean-side mixture whose air ratio (the ratio of the amount of air to the amount of fuel) is in excess of 1.0 is burned at lean-side flame holes while for the stabilization of combustion flames, rich-side flame holes, at which a rich-side mixture whose air ratio falls below 1.0 is burned, are arranged adjacent to the lean-side flame holes. As such a rich-lean combustion burner, there has been proposed a rich-lean combustion burner which is flat in shape as a whole. More specifically, this rich-lean combustion burner is formed by joining and welding together various types of formation members provided by stamping (press-forming) of thin plate materials into predetermined shapes. For example, Patent Literature Publication 1 discloses such a rich-lean combustion burner that a row of lean-side flame holes is formed by partition in the middle relative to the width direction and two rows of rich-side flame holes are formed respectively on either side of the lean-side flame hole row, whereby the rich-side flame hole rows on both sides are arrayed in opposing relation to each other across the lean-side flame hole row positioned in the middle of the burner. In addition, Patent Literature Publication 2 also discloses such a rich-lean combustion burner that two rows of rich-side flame holes of secondary burners on both sides are arranged in opposing relation to each other across a row of lean-side flame holes of a main burner. As an assembly method for assembling such a rich-lean combustion burner, there has been proposed an assembly method, in accordance with which assembly method there are prepared a lean-side flame hole formation member formed by placing a plurality of metallic sheets one upon the other so as to define a plurality of slit-like clearance gaps therebetween, and a secondary burner formed by partially connecting metallic plates on both sides by means of bridge formation at their upper ends. And the secondary burner is placed from above the lean-side flame hole formation member so as to assemble a rich-lean combustion burner. Furthermore, Patent Literature Publication 3 proposes, as a method of forming a lean-side flame hole formation member of the type described above, a formation method. In accordance with this formation method, a single metallic plate is subjected to stamping (press forming) for forming convexo-concave portions in a flame hole part. Then, the metallic plate thus prepared is folded along given fold lines into such a state that a plurality of strip-like metallic plates are placed one upon the other. These plural strip-like metallic plates are connected by joining of flat surfaces at both longitudinal ends thereof. In addition, their middle portions relative to the width direction are spaced apart a predetermined distance, thereby forming a lean-side flame hole formation member in which a great number of slit-like lean-side flame holes are formed by partition between the middle portions. And, in the middle position relative to the width direction, the lean-side flame hole formation member is fitted into a space to which a lean-side mixture is supplied, whereby the lean-side flame hole formation member is assembled, with their both ends nipped in between the ends of the rich-side flame hole formation member.

CITATION LIST

Patent Literature

Patent Literature Pub. 1: JP-A-H07-42913
Patent Literature Pub. 2: JP-A-H07-91620
Patent Literature Pub. 3: JP-A-H07-127819

SUMMARY OF INVENTION

Technical Problem

Incidentally, the applicant of the present invention is now trying to develop, as a substitute for the rich-lean combustion burners proposed in Patent Literature Publications 1-3 in which it is simply arranged that two rows of rich-side flame holes are arrayed respectively on either side of a row of lean-side flame holes, a rich-lean combustion burner which employs a configuration comprising an additional row of rich-side flame holes which extends on the centerline of the lean-side flame hole row. That is, these rich-side and lean-side flame holes are alternately arranged, for example, in a flame arrangement sequence in the lateral direction (i.e., in the width direction): RICH-LEAN-RICH-LEAN-RICH. Therefore, the applicant of the present invention is now developing, as an assembly method applicable to such a rich-lean combustion burner, an assembly method in which various types of formation members are fitted together so as to assemble a rich-lean combustion burner, as exemplarily shown in FIG. 22. To this end, four different types of formation members, prepared by means of stamping and bending of metallic plate materials into predetermined shapes, are employed to assemble a rich-lean combustion burner. These four different formation members to be used are: first formation members 400, 400; a pair of second formation members 500, 500; a third formation member 600; and fourth formation members 700, 700. The first formation members 400, 400 are formed by joining together a pair of metallic plate materials placed face to face with each other whereby there is formed between the opposing metallic plate materials a lean-side mixture channel or the like having an elongated opening at the upper end side. The second formation members 500, 500 are overlapped from outside of the first formation members 400, 400 which are joined together, whereby rich-side mixture channels are formed by partition on both outsides while slit-like rich-side flame holes are formed by partition at the upper end side. The third formation member 600 used to form rich-side flame holes situated in the middle is prepared as follows. That is, by folding and joining of a single metallic plate, there are partitioned, between the opposing sides thereof, rich-side mixture channels and slit-like rich-side flame holes. And the member thus prepared is inserted and mounted from above into the central position, relative to the width direction, of the upper end opening of the first formation members 400, 400. The fourth formation members 700, 700 are inserted and mounted from above into the upper end opening of the first formation members 400, 400 at positions on either outside of the third formation member 600, whereby on both sides lean-side flame holes are arranged in opposing relation to each other across the central rich-side flame holes. To sum up, by the third formation member 600, there is formed, at a middle position relative to the width direction, a central rich-side burner part having central rich-side flame holes. And by the first formation members 400, 400 and the fourth formation members 700, 700, there are formed, at positions on both outsides of the central rich-side burner part, lean-side burner parts having lean-side flame holes. And further by the second formation members 500, 500, there are formed, at positions on both outsides, outer rich-side burner parts having rich-side flame holes.

However, in the example of the assembly method as shown in FIG. 22, it can be conceivable that the following troublesome conditions may take place particularly during assembly of the fourth formation members 700, 700. That is, it is conceivable that troublesome conditions may take place especially when inserting and mounting each of the fourth formation members 700, 700 from above into elongated clearance gaps on both sides in the width direction so that the fourth formation members 700, 700 are assembled, wherein the elongated clearance gaps are gaps which are defined by partition by inserting and mounting from above the third formation member 600 into the widthwise middle position of the upper end opening of the first formation members 400, 400 in a joined state. The pair of the fourth formation members 700, 700 are members which are used to form lean-side flame holes. However, although the fourth formation members 700, 700 are identical with each other in their shape, it is required that, when inserted and mounted into positions on both widthwise sides of the third formation member 600, they are inserted so as to be mounted in opposing relation to each other. In other words, there is a directional property in such assembly, which may easily lead to man-caused errors and reduction in workability at the time of assembly.

In addition, the first formation members 400, 400, the second formation members 500, 500 and the third formation member 600 are assembled, with their end edges in the front-back direction nipped together. On the other hand, the fourth formation member 700 is assembled by being inserted and mounted from above into the upper end opening, therefore easily leading in particular to deviations or errors with respect to the central rich-side flame holes of the third formation member 600 and the outer rich-side flame holes of the second formation members 500, 500 on both outer sides, in relative positional relation in the width, the front-back and the vertical directions. If there occurs such a deviation or error regarding the mounting position, this will cause relative positional relation between the rich-side flame holes and the lean-side flame holes to deviate out of the originally intended one. Therefore, there is the possibility that the desired function to stabilize rich-side flames by lean-side flames may no longer be accomplished. Further, it is required that, by assembly to bring both side surfaces of each fourth formation member 700 into close contact with the third formation member 600 and the first formation member 400, there should be formed by partition a separating space so that nothing flows in a base boundary position between lean-side flames issued from the lean-side flame holes formed by each fourth formation member 700 and rich-side flames issued from the rich-side flame holes lying adjacent, on both sides in the width direction, to the lean-side flame holes. In spite of that, if close contactability in the vicinity of the end in the longitudinal direction is reduced due to an error or the like as described above, resulting in creation of a clearance gap, this will cause leakage of lean-side mixture to the separating space, thereby causing conditions that reduce flame retainability.

For example, if an assembly structure as shown in FIG. 23 is employed, there is the possibility that the following troublesome conditions may take place. That is, in accordance with the assembly structure of FIG. 23, a central rich-side flame hole formation member 101 and rich-side flame hole formation members 102, 102 on either outside of the central rich-side flame hole formation member 101 are firmly fixed together by means of plane-to-plane joining (e.g., welding) of the flange parts at their respective longitudinal ends and in addition, a pair of assembly grooves 103, 103 are formed by partition between the flange parts. This forms spaces 104, 104 by partition to which lean-side mixture is supplied between the both outer rich-side flame hole formation members 102, 102 which are arranged in opposing relation to each other across the central rich-side flame hole formation member 101. And for example, a pair of lean-side flame hole formation members 105, 105 are formed by joining of three metallic plate materials. And the lean-side flame hole formation members 105, 105 are fitted one by one into the spaces 104, 104 which are supplied with lean-side mixture and their longitudinal ends are inserted respectively into the assembly grooves 103, 103 so that they are assembled together. In this case, since they are joined and fixed firmly at their respective longitudinal ends, this makes it impossible to adequately secure close contactability if a deviation or assembly error occurs, therefore causing the possibility that the foregoing troublesome conditions may take place.

Hence, particularly with a rich-lean combustion burner which comprises such an assembly composed of various types of formation members that two rows of lean-side flame holes are arranged in opposing relation to each other across a row of central rich-side flame holes and another two rows of rich-side flame holes are arranged respectively outside the two lean-side flame hole rows, the technical problem to be solved is to, while intending to achieve facilitation and assurance of the assembly of formation members used to form two lean-side flame hole rows, enable an accurate assembly of the formation members in the horizontal, front-to-back, vertical directions in positional relation relative to the other formation members.

Solution to Problem

The present invention is directed to a rich-lean combustion burner which comprises: a) central rich-side flame holes which are arranged in one row so as to extend in the longitudinal direction in the middle relative to the lateral direction, b) lean-side flame holes which are arranged in two rows so as to sandwich the central rich-side flame hole row therebetween from both sides relative to the lateral direction and c) outer rich-side flame holes which are arranged in two rows so as to sandwich the two lean-side flame hole rows on both sides therebetween from outside. And the rich-lean combustion burner in accordance with the present invention has the following specific particulars. That is, there is provided a flame hole formation member used to form the two lean-side flame hole rows wherein the flame hole formation member is assembled by being inserted and mounted from above in a formation member used to form the central rich-side flame hole row. And, the flame hole formation member includes: i) a pair of flame hole formation parts used to form the lean-side flame holes of each of the two lean-side flame hole rows and ii) at least one or more bridge formation parts for connecting respective upper end portions or respective side end portions of the pair of the flame hole formation parts, and the pair of the flame hole formation parts are in advance held integrally with each other by the bridge formation part in such a state that the pair of the flame hole formation parts are positioned face to face with each other and spaced apart at an interval of a predetermined distance so as to sandwich therebetween the formation member used to form the central rich-side flame holes from both sides relative to the lateral direction.

In comparison with the case where flame hole formation parts are individually formed separate members and they are separately assembled to the formation member used to form central rich-side flame holes, it is possible for the rich-lean combustion burner according to the present invention to eliminate assembly errors (e.g., upside down assembly, misunderstanding about orientation to a formation member used to form central rich-side flame holes and other like error), whereby it becomes possible to avoid decrease in assembly workability due to such an error. Furthermore, it is possible to assemble a pair of flame hole formation parts by carrying out a single assembly operation, thereby making it possible to achieve further improvement in assembly workability. In addition, since it is positively ensured that the distance between an opposing pair of hole formation parts is maintained in advance at an intended distance by the bridge formation parts, which makes it possible to equalize the state of assembly, in which the formation member used to form central rich-side flame holes is sandwiched between the hole formation parts, when compared to the case where the flame hole formation part is composed of individually formed separate members. Therefore, close contactability between the formation member used to form central rich-side flame holes and each of the flame hole formation members disposed so as to sandwich therebetween the central rich-side flame hole formation member from both sides is equalized and ensured to a further extend. This secures sealability (metal seal) for preventing a mixture or the like from leakage, thereby making it possible to maintain flame retainability during rich-lean combustion at high levels. In addition, it becomes possible to not only provide facilitation and assurance of the positioning in the lateral direction, but also it becomes possible to perform assembly operations with more accurate positioning relative to the lateral direction.

In the rich-lean combustion burner according to the present invention, it may be arranged that in the upper end area of the pair of the flame hole formation parts, a plurality of the bridge formation parts are formed a plurality of positions spaced apart in the longitudinal direction at intervals of a predetermined distance. Such an arrangement makes it possible that the one pair of the flame hole formation parts are assembled in a further stable state to the formation member used to form central rich-side flame holes.

In addition, in the rich-lean combustion burner according to the present invention, it may be arranged that the bridge formation part is formed so as to come into abutment with the formation member used to form the central rich-side flame holes in such a state that the bridge formation part sits from above astride the upper end edge of the central rich-side flame hole formation member. This arrangement makes it possible to ensure that the lean-side flame holes formed by the one pair of the flame hole formation parts are situated at predetermined vertical relative positions with respect to the central rich-side flame holes.

In the rich-lean combustion burner according to the present invention, it may be arranged that: the bridge formation part is formed into a shape of a strip-like plate extending in the lateral direction; there is formed, in the upper end edge of the formation member used to form the central rich-side flame holes, an engagement groove into which the bridge formation part is fitted from above; and by fitting of the bridge formation part into the engagement groove, the flame hole formation member is assembled in such a state that its movement in the longitudinal direction is controlled. This arrangement makes it possible to accomplish facilitation and assurance of the positioning of the flame hole formation member in the longitudinal direction at the time of assembly thereof. In addition, the flame hole formation member is assembled in such a state that deviations, especially with respect to the longitudinal direction, are prevented without failing.

In the rich-lean combustion burner according to the present invention, it may be arranged that the bridge formation part has an upper surface which lies either in flush with or lower than the upper surface of the central rich-side flame holes. This arrangement makes it possible to prevent the bridge formation part from undergoing burn phenomenon in the combustion operation of the rich-lean combustion burner, whereby it is possible to avoid worsening of the flame retainability in the rich-lean combustion state due to burn phenomenon.

In the rich-lean combustion burner according to the present invention, it may be arranged that the formation member used to form the central rich-side flame holes is provided, in the vicinity of its upper end, with a projecting part projecting outward in the lateral direction while there is formed, in the innermost surface of the flame hole formation member, a concave part, whereby it is configured that the projecting part is fitted into the concave part to thereby prevent the flame hole formation part from coming loose in the upward direction. This arrangement makes it possible to prevent each of the flame hole formation parts of the flame hole formation member from coming loose in the upward direction, thereby providing a loosing prevention function.

In the rich-lean combustion burner according to the present invention, it may be arranged that the flame hole formation member is provided using a flame hole formation material in the form of a developed sheet, the material sheet comprising at least two partially connected strip-like plate parts which are used to form the flame hole formation parts on both sides so that the flame hole formation parts are placed in opposing relation to each other across the bridge formation part, and the flame hole formation material sheet is bent at positions where the bridge formation parts and the strip-like plate parts are connected whereby the flame hole formation member is integrally formed as one piece. This arrangement makes it possible that flame hole formation members are easily and reliably manufactured in mass production.

In the rich-lean combustion burner according to the present invention, it may be arranged that the lean-side flame holes each are formed by assembling a plurality of distributing plates so that clearance gaps are left between ones of the plural distributing plates in opposing relation to each other, thereby forming flow channels for lean-side mixture, and the longitudinal end of the outermost one of the plural distributing plates is made to curve outward so as to describe a convex curve in plan view so that the longitudinal leading end of the outermost distributing plate overlaps the longitudinal leading end of the innermost one of the plural distributing plates. This arrangement makes it possible that even when employing a configuration prone to accumulation of process errors and assembly locating errors (e.g., a configuration in which lean-side flame holes formed by a plurality of distributing plates are disposed oppositely on either side of central rich-side flame holes), it is still possible to realize easy and reliable assembly while ensuring that the distributing plates used to form lean-side flame holes and the members used to form rich-side flame hole disposed outside the lean-side flame holes are maintained in a closely contact state with one another. Stated in another way, even if the inner width of a space in which to arrange a plurality of distributing plates forming lean-side flame holes becomes slightly narrower than the original width due to process errors or the like, this is absorbed because the curbed longitudinal end is pushed to become elastically deformed so as to extend towards the leading end, whereby close contactability between the outermost distributing plate and the members used to form outer rich-side flame holes is maintained. In this case, even if the curved longitudinal end is pushed to extend in the direction of the leading end, the leading end of the innermost distributing plate will not interfere with elastic deformation of the curved longitudinal end, thereby not only facilitating assembly but also maintaining close contactability. And, it is possible to maintain close contactability, thereby making it possible to ensure that the possibility of leakage of lean-side mixture from the lean-side flame holes is eliminated without fail. As a result, it is possible to ensure that worsening of the flame retainability due to leakage is avoided.

In the rich-lean combustion burner according to the present invention, it may be arranged that the longitudinal end of the outermost distributing plate undergoes elastic deformation according to material elasticity, thereby being in close contact with the inner surface of the formation member used to form the outer rich-side flame holes. This arrangement makes it possible that even if the inner width of a space in which to arrange a plurality of distributing plates used to form lean-side flame holes becomes slightly wider than the original size due to process errors or the like, the longitudinal leading end of the outermost distributing plate is allowed to follow such a condition while being in close contact to the inner surface of the formation member used to form rich-side flame holes because of elastic restitution deformation of the curved longitudinal end, whereby maintenance of the state of close contact between the longitudinal end and the inner surface is easily realized.

In the rich-lean combustion burner in accordance with the present invention, it may be arranged that the longitudinal end of another distributing plate adjacent to the innermost distributing plate is curved in the direction of the innermost distributing plate. This arrangement makes it possible that even if with the variation in the inner width of a space in which to arrange a plurality of distributing plates used to form lean-side flame holes, there is applied to the innermost distributing plate a pressing pressure that forces the innermost distributing plate to approach its adjoining distributing plate, the curved leading end of the adjoining distributing plate comes into contact with the innermost distributing plate whereby a predetermined amount of clearance gap for the lean-side flame holes is secured and maintained.

If any one of the rich-lean combustion burners as set forth above is incorporated into a combustion apparatus, this makes it possible for the combustion apparatus to provide the same advantageous effects that the incorporated rich-lean combustion burner provides.

BRIEF DESCRIPTION OF DRAWINGS

In the drawing:

FIG. 1, comprised of FIG. 1(*a*) and FIG. 1(*b*), shows an example of a combustion apparatus into which a rich-lean combustion burner according to the present invention is incorporated, wherein FIG. 1(*a*) is an illustration diagram showing a perspective view of the rich-lean combustion burner and FIG. 1(*b*) is an illustration diagram showing a cross-sectional view of the rich-lean combustion burner;

FIG. 3 is comprised of FIG. 3(*a*) and FIG. 3(*b*), wherein FIG. 3(*a*) is a top plan view of the burner of FIG. 2 and FIG. 3(*b*) is a partially enlarged view of an F-F part of FIG. 3(*a*);

FIG. 17 is comprised of FIG. 17(*a*) and FIG. 17(*b*) wherein FIG. 17(*a*) is an enlarged view of an H part of FIG. 2 and FIG. 17(*b*), which is a corresponding view to FIG. 17*a*, shows a state with exclusion of the flame hole formation member of FIG. 17(*a*);

DESCRIPTION OF EMBODIMENTS

Figure 2:
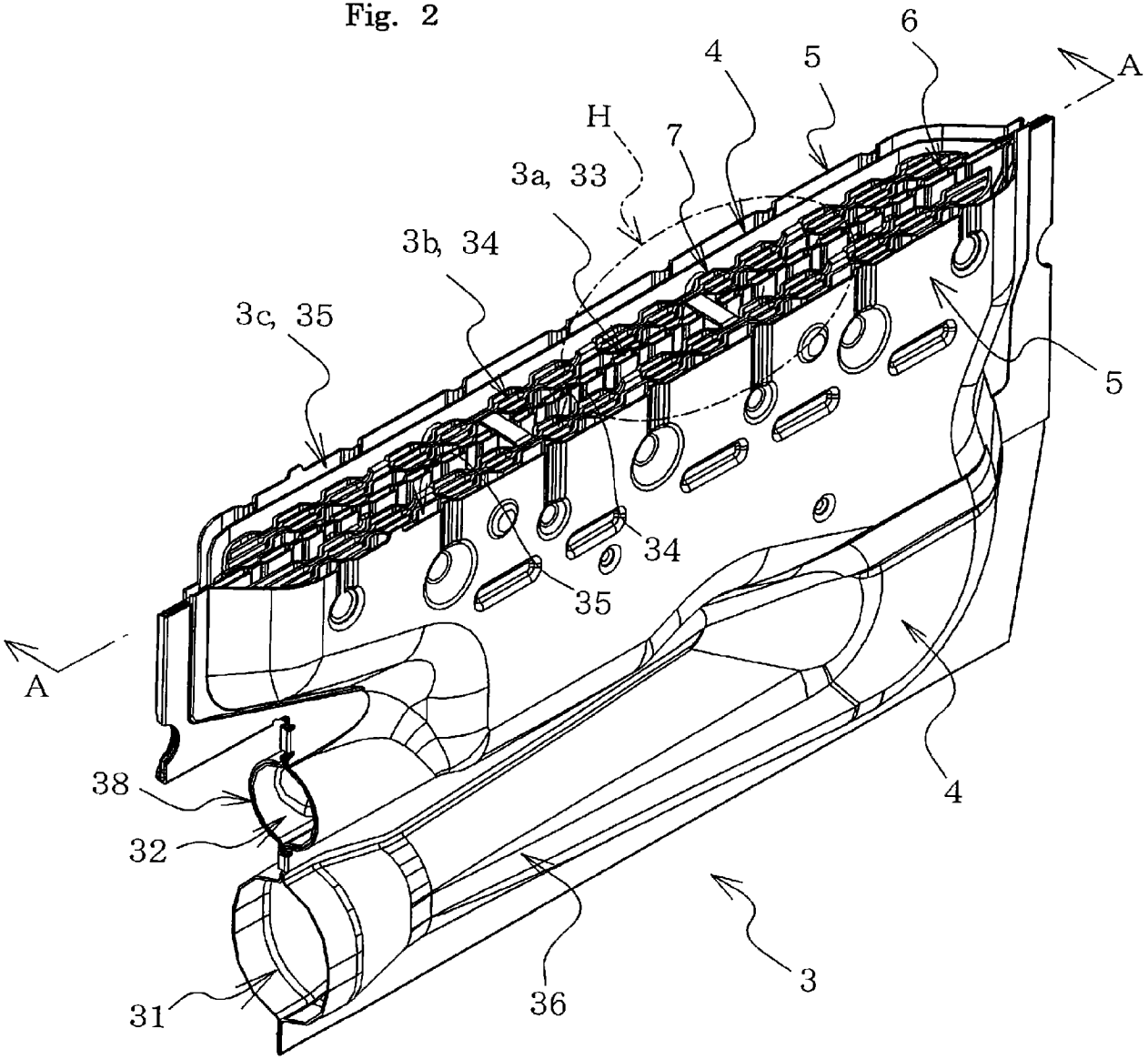
FIG. 2 is a perspective view of a rich-lean combustion burner according to an embodiment of the present invention.

Hereinafter, embodiments of the present invention will be described with reference to the drawing figures.

Referring to FIG. 1, there is shown a combustion apparatus 2 which employs a rich-lean combustion burner formed in accordance with an embodiment of the present invention. The combustion apparatus 2 includes a can body 21 to which a set of burners comprising a predetermined number of rich-lean combustion burners 3, 3, . . . which are arrayed adjacently to one another in the lateral direction, is firmly attached. An upper space of the can body 21 serves as a combustion space 22 while a lower space 23 thereof is supplied with combustion air from an air distribution fan 24. There is disposed on one side of each rich-lean combustion burner 3 a gas manifold 25 (shown only in FIG. 1(*b*)), and projected from the gas manifold 25 to its corresponding rich-lean combustion burner 3 are two gas nozzles 26, 27. One of the gas nozzles (the lower one), i.e., the gas nozzle 26, is configured so as to be able to jet fuel gas in the direction of a first supply port 31 of the rich-lean combustion burner 3 while on the other hand the other of the gas nozzles (the upper one), i.e., the gas nozzle 27, is configured so as to be able to jet fuel gas in the direction of a second supply port 32 of the rich-lean combustion burner 3. A stream of air from the lower space 23 is forced in from around each of the gas nozzles 26 and 27 by discharge pressure of the air distribution fan 24 so that both fuel gas and air are supplied to the first and the second supply ports 31, 32. In this case, it is arranged such that the diameter of the first supply port 31 is set to be considerably larger than the outer diameter of the nozzle 26 to thereby allow much more air to be forced in while on the other hand the diameter of the second supply port 32 is set to be slightly larger than the outer diameter of the nozzle 27 to thereby reduce the amount of air to be forced in.

In this way as described above, the first supply port 31 supplies, in addition to fuel gas to be supplied therefrom, air so that the amount of air greater than the amount of fuel gas is supplied to the inside at a predetermined air ratio of in excess of 1.0, while on the other hand the second supply port 32 likewise supplies, in addition to fuel gas to be supplied therefrom, air so that the amount of air smaller than the amount of fuel gas is supplied to the inside at a predetermined air ratio of less than 1.0. In addition, there is disposed a distributing plate 28 (see FIG. 1(*b*)) which is disposed so as to serve as a partition between the lower space 23 and the rich-lean combustion burners 3, 3, . . . , and there are opened through the distributing plate 28 a great number of small bores, whereby secondary air is supplied between adjacent ones of the rich-lean combustion burners 3, 3, . . . through these small bores.

As shown in FIG. 2, the rich-lean combustion burner 3 is a rich-lean combustion burner that is formed as follows. That is, the rich-lean combustion burner 3 is formed by processing a metallic plate material into a predetermined shape by means of stamping (press forming) and bending. The rich-lean combustion burner 3 comprises a central rich-side burner part 3*a* which is composed of a single rich-side flame hole row 33, a lean-side burner part 3*b* which is composed of two lean-side flame hole rows 34, 34 and an outer rich-side burner part 3*c* which is composed of two rich-side flame hole rows 35, 35. The rich-lean combustion burner 3 is formed having a flattened shape as a whole and these burner parts are formed using three different types of plate members 4, 4, 5, 5, 6 and a pair of flame hole formation members 7, 7. Here, if it is assumed that the top-bottom direction of FIG. 3 is taken as the longitudinal direction (the front-back direction) while the horizontal direction of FIG. 3 is taken as the lateral direction (the width direction), the first supply port 31 is opened at a lower side position on one longitudinal side while the second supply port 32 having a smaller diameter than the first supply port 31 is opened at an upper side position, and a plurality of flame hole rows where combustion flames are produced are formed in the upper end surface so as to extend in the longitudinal direction, as shown in FIG. 3. FIGS. 3 (*a*) and 3(*b*) show, as flame hole rows, (i) a rich-side flame hole row 33 of narrow width which is situated in the middle relative to the lateral central and which extends for the entire longitudinal length, (ii) two lean-side flame hole rows 34, 34 of relatively wide width which are disposed respectively on either lateral side of the rich-side flame hole row 33 and which extend for the entire longitudinal length and (iii) two rich-side flame hole rows 35, 35 of narrow width which are disposed respectively outside the two lean-side flame hole rows 34, 34 and which extend for the entire longitudinal length. And, a lean-side mixture, supplied from the first supply port 31 (see FIG. 2) and then mixed, is directed to each lean-side flame hole 341 in the lean-side flame hole rows 34, 34, and lean-side flames are produced by burning of the lean-side mixture. On the other hand, a rich-side mixture, supplied from the second supply port 32 (see FIG. 2) and then mixed, is directed to each rich-side flame hole 331 in the central rich-side flame hole row 33 and to each rich-side flame hole 351 in the two outer rich-side flame hole rows 35, 35, and rich-side flames are produced by burning of the rich-side mixture.

Figure 4:
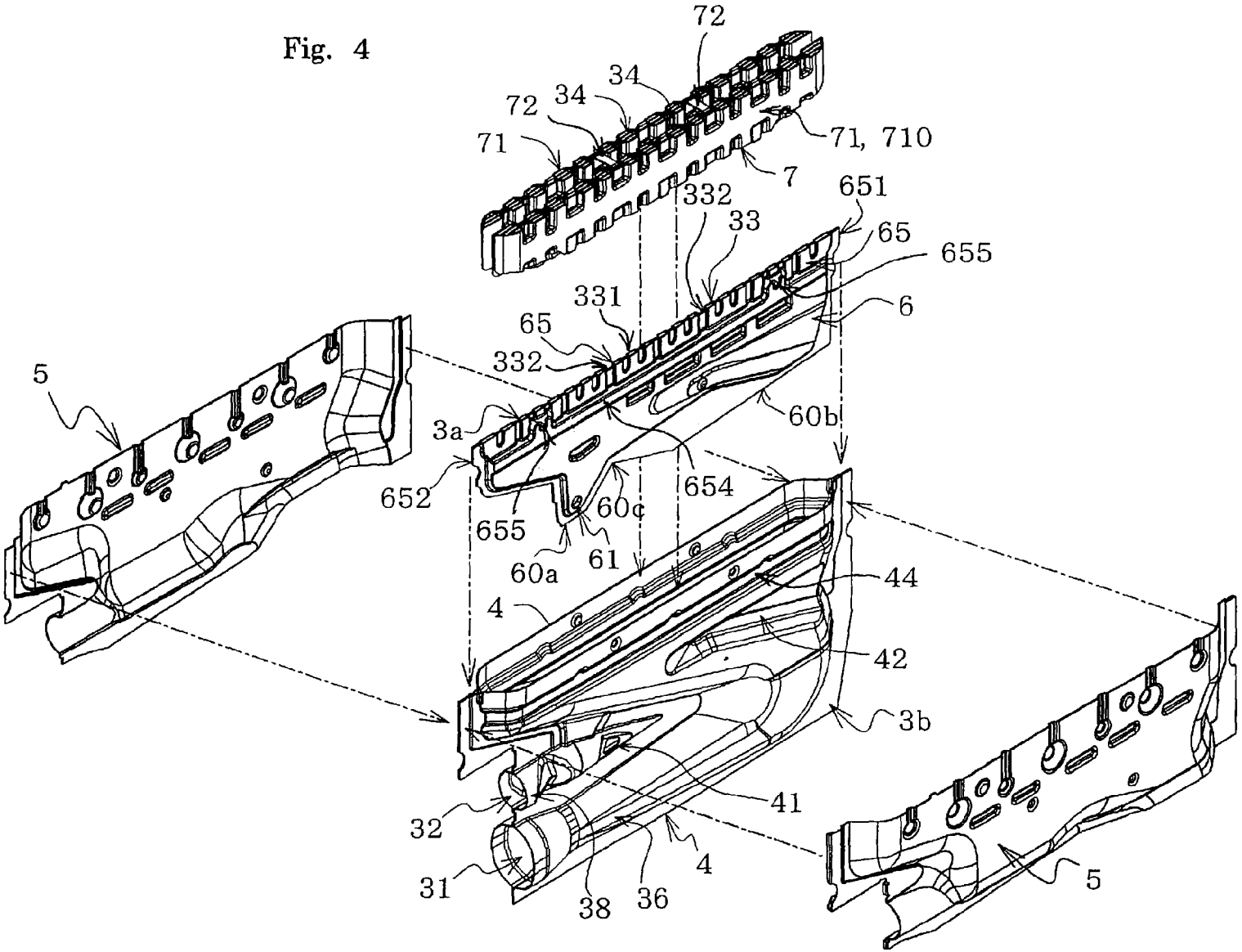
FIG. 4 is an exploded perspective view illustrating, in exploded manner, a first plate member which constitutes a lean-side burner part, a second plate member which constitutes an outer rich-side burner part, a third plate member which constitutes a central rich-side burner part and a flame hole formation member which constitutes lean-side flame hole rows to be disposed respectively on either side of the central rich-side burner part.
Figure 5:
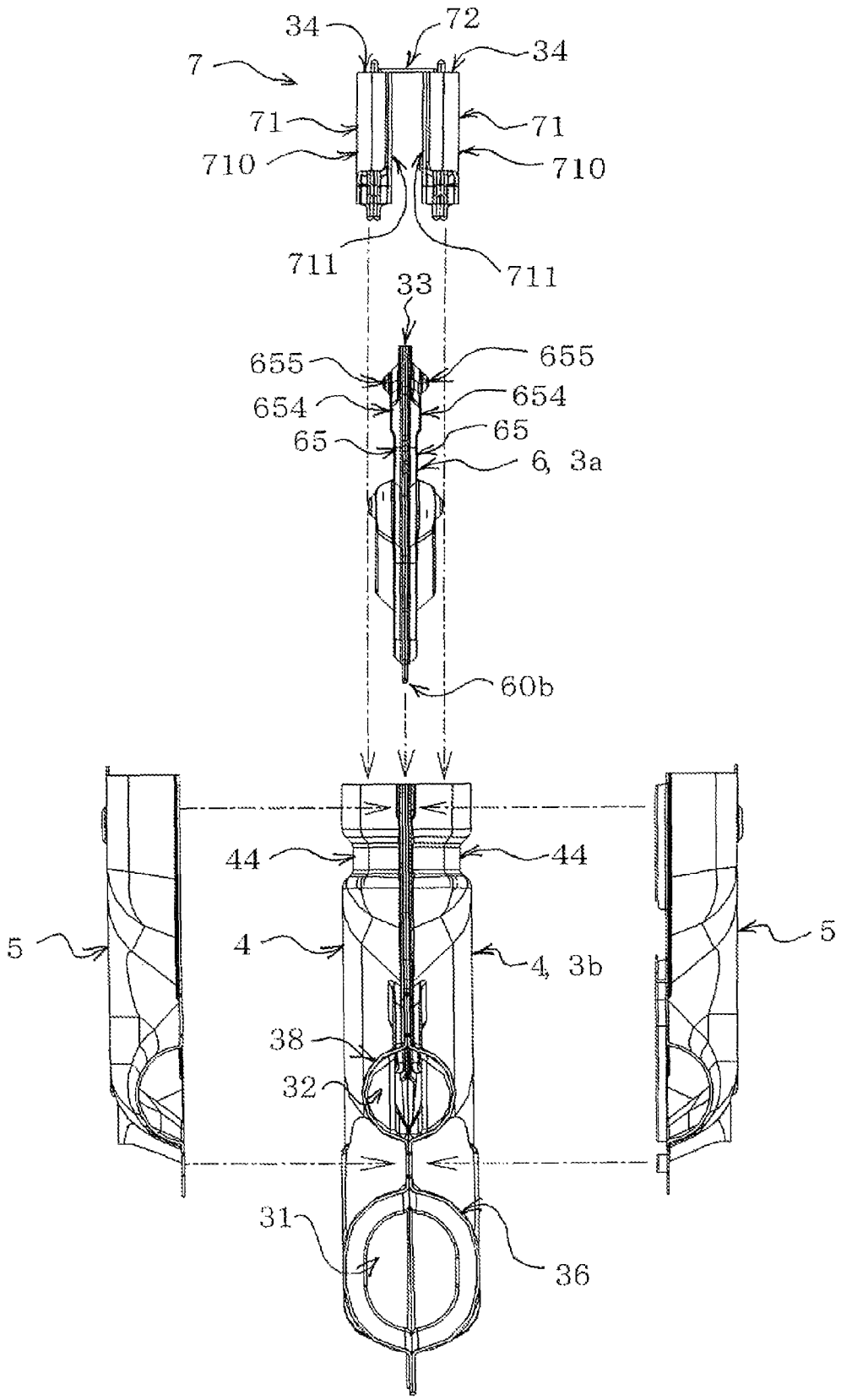
FIG. 5 is an exploded side view depicting an exploded state of FIG. 4 as viewed from one longitudinal side.
Figure 6:
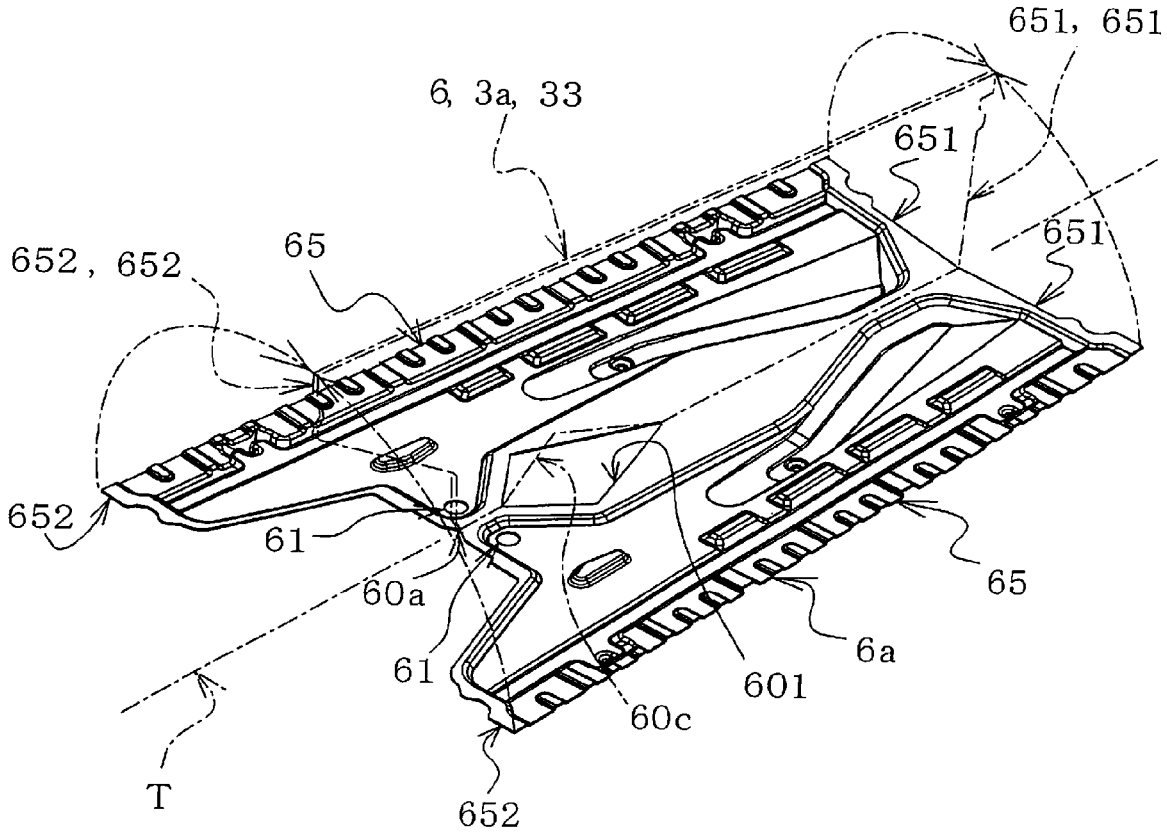
FIG. 6 is a perspective view of the third plate member of FIG. 4 or FIG. 5 in a developed state.

For example, the rich-lean combustion burner 3 as described above is formed as follows. That is, as shown in FIG. 4 and FIG. 5, the rich-lean combustion burner 3 is configured using three different types of plate members 4, 4, 5, 5, 6 and a flame hole formation member 7 including a pair of flame hole formation members 7, 7 that are connected integrally with each other by at least one or more single bridge formation parts 72 (two bridge formation parts 72, 72 in the example shown in the figure). The third plate member 6 (see FIG. 6) is formed as follows. That is, a thin plate material is stamped and formed into a plate member 6*a* in the form of a single sheet so that a plate part 65 serving as one side surface and another member part 65 serving as the other side surface, these side surfaces subsequently being positioned face to face with each other, are placed in a state that they are in an axisymmetric arrangement across a fold line T. Then, the plate member 6*a* after stamping formation is folded inward (in the direction indicated by alternate long and short dash line) around the fold line T so that the plate parts 65, 65 on both sides are in opposing relation to each other. Thereafter, rear end edges 651, 651, and front end edges 652, 652) are brought into close contact with each other whereby to form the third plate member 6. After the plate member 6*a* is folded, folded parts along the fold line T serve lower end parts 60*a*, 60*b* respectively (see also FIG. 4). The plate parts 65, 65 extending upward respectively from the lower end parts 60*a*, 60*b* are in opposing relation to each other with a predetermined narrow interval held between the plate parts 65, 65. There is defined between the inner surfaces of the plate parts 65, 65 a rich-side mixture supply channel in fluid communication with the rich-side flame hole row 33 in the upper end surface. In addition, along the fold line T, first communication holes 61 are formed respectively through the plate parts 65, 65 in the lower end part 60*a* on the front end side. And, in the plate member 6*a* in a developed spate (see FIG. 6), a notched opening 601 having an approximate rhomboid shape is preformed at the back of the first communication holes 61, 61 across the fold line T. And, a notched concave part 60*c* (see also FIG. 4) is formed in a folded state. In this way, the third plate member 6 forms a central rich-side burner part 3*a*.

Figure 7:
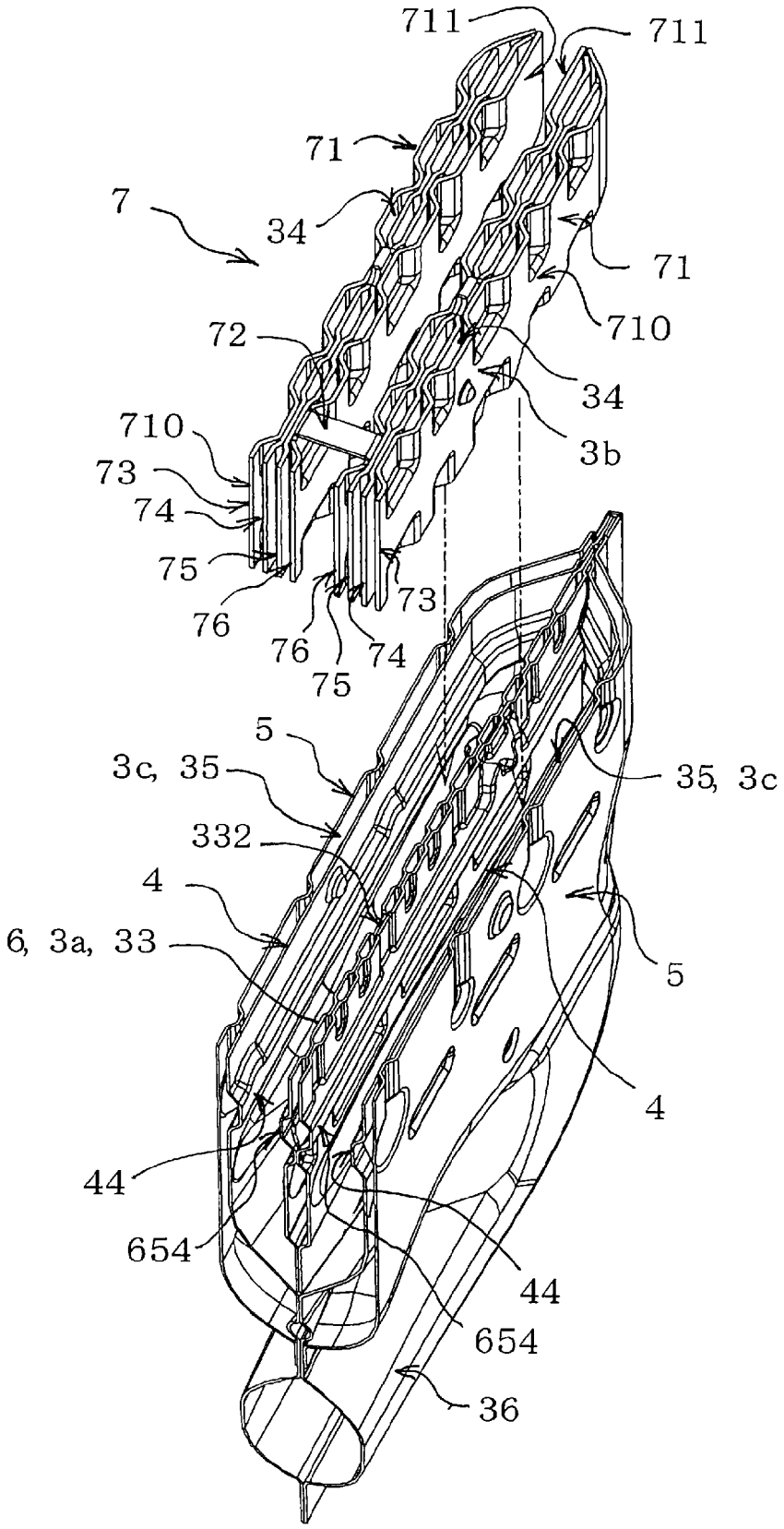
FIG. 7 is a reference diagram showing, in exploded manner, procedures to insert and mount the flame hole formation member in such a state that the first, the second and the third plate members are assembled.

And, the central rich-side burner part 3*a* is inserted downward into the inside through an upper end opening defined between the pair of the first plate members 4, 4, whereby the central rich-side burner part 3*a* is placed centrally, relative to the lateral direction, between the first plate members 4, 4 (see FIG. 7) and the upper end opening of the first plate members 4, 4 is placed in such a state that it is partitioned by the central rich-side burner part 3*a* into two sections. Then, the flame hole formation member 7 is inserted downward and mounted in the upper end opening which has been partitioned into two sections, and the pair of the flame hole formation parts 71, 71 forming the flame hole formation member 7 are assembled into such a state that they enclose the rich-side flame hole row 33 of the central rich-side burner part 3*a* from both lateral sides. At the time of this assembly, the bridge formation parts 72, 72 of the flame hole formation member 7 are fitted into concave engagement grooves 332, 332 which are formed in the rich-side flame hole row 33 of the third plate member 6. This forms two rows of lean-side flame hole rows 34, 34 in the upper end surfaces of the pair of the flame hole formation parts 71, 71 (see also FIG. 3), whereby there is formed a lean-side burner part 3*b*. In addition, the method of manufacture of the flame hole formation member 7 and its assembly structure will be described later. The second plate members 5, 5 are placed respectively upon the outsides of the first plate members 4, 4 of the lean-side burner part 3*b* (for example, see FIG. 5) whereby the rich-side flame hole rows 35, 35 are formed on the upper end side (see FIG. 3) while supply channels through which rich-side mixture is supplied to each rich-side flame hole row 35 are formed by partition between the inner surface of each second plate member 5 and its opposing outer surface of the first plate member 4, thereby forming an outer rich-side burner part 3*c* (see FIG. 2 and FIG. 3).

Figure 8:
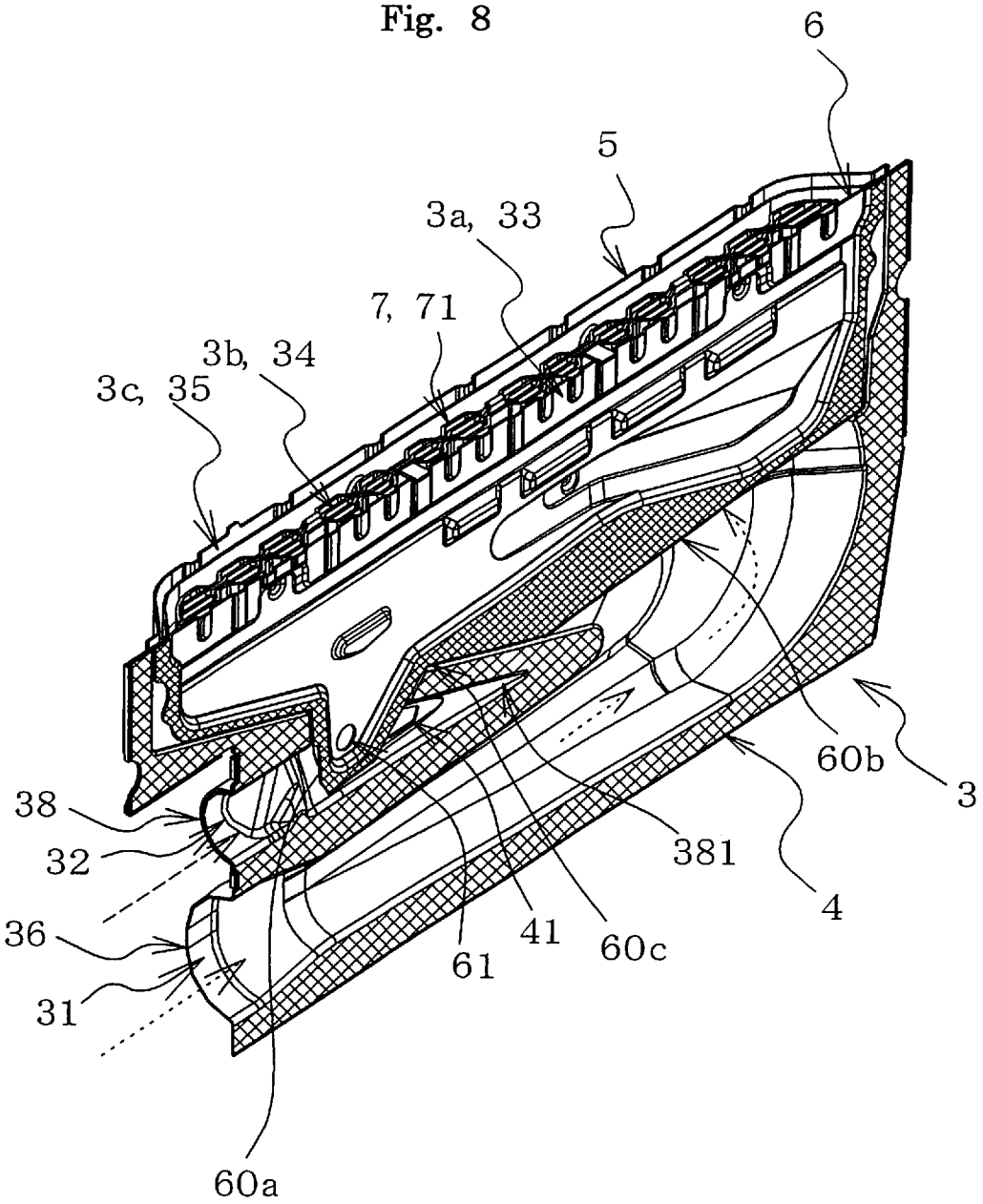
FIG. 8 is a perspective view showing a state taken along line A-A of FIG. 2.
Figure 9:
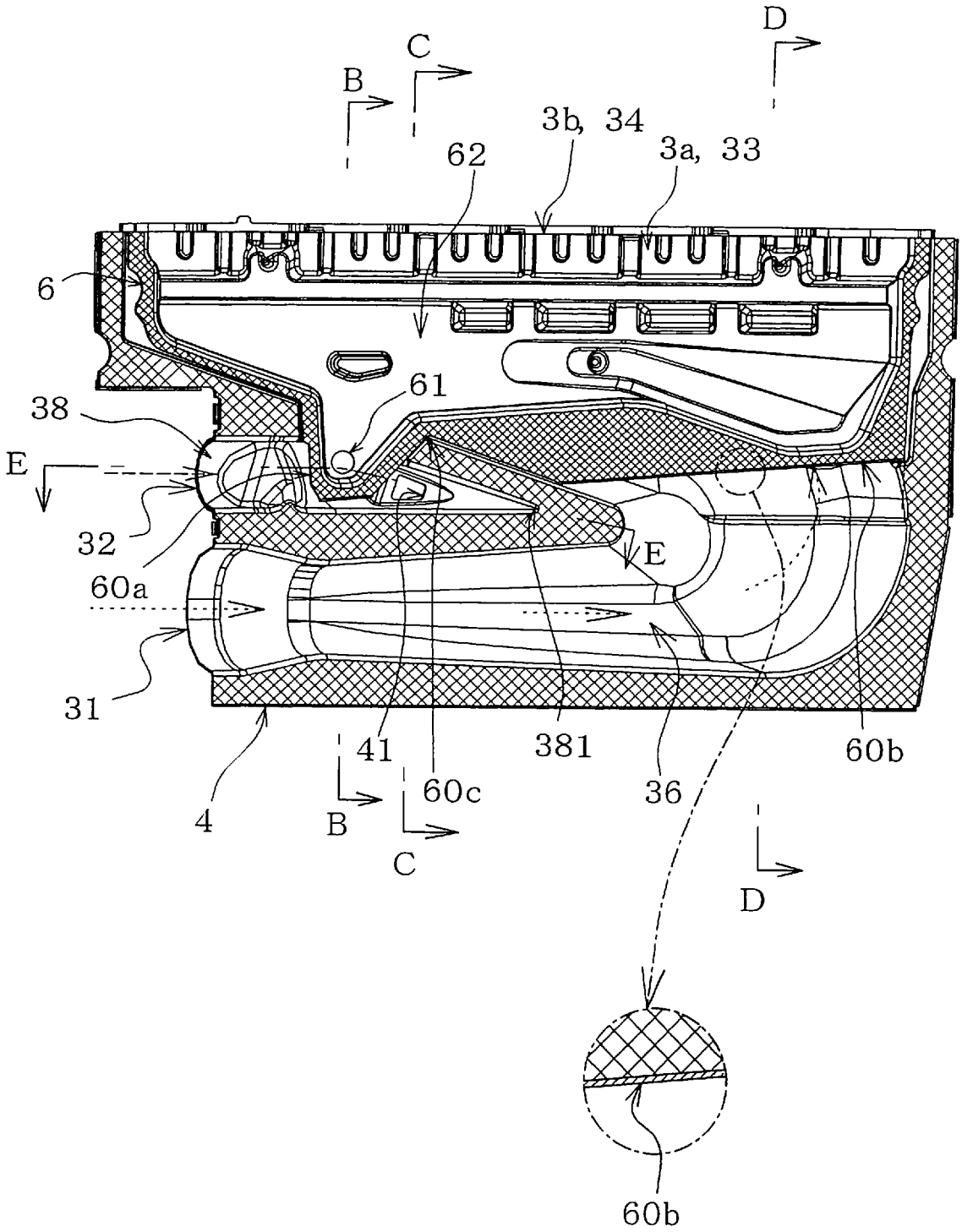
FIG. 9 is a front view showing a state taken along line A-A of FIG. 2.
Figure 10:
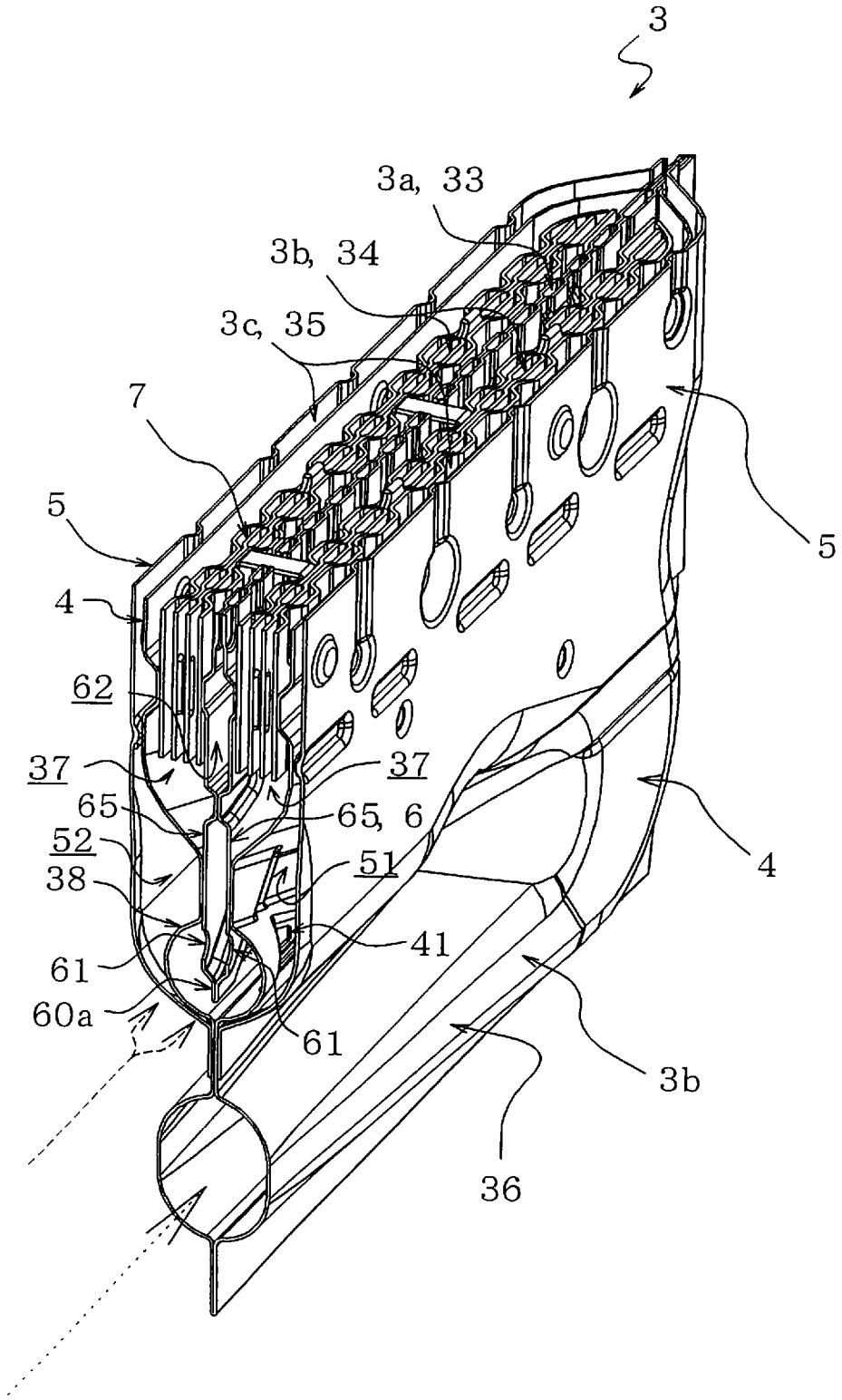
FIG. 10 is a partial perspective view of the rich-lean combustion burner when cut at a position corresponding to line B-B of FIG. 9.

Next, referring now to FIG. 8 and FIG. 9, a description will be given regarding supply structures for the lean-side and rich-side mixtures. In addition, the sections indicated by mesh-like hatching are joint surfaces. These joint surfaces are closely jointed together by close contact or by press contact and are maintained in close contact with each other by additional liner welding or spot welding. In the interior of a tubular part 36 of the lean-side burner part 3*b*, fuel gas and air each supplied from the first supply port 31 which is opened on one side are mixed together into a lean-side mixture. The lean-side mixture is fed to the other side through the tubular part 36 (see dotted arrow in FIG. 10 and FIG. 11). Then, at the other side, the lean-side mixture changes its direction to flow upward and is fed, through two inner spaces 37, 37 formed by partition (division) of a space between the pair of the first plate members 4, 4 by the lower end part 60*b* of the third plate member 6, to each lean-side flame hole row 34 at the upper end. The tubular part 36 and the inner spaces 37, 37 together form lean-side mixture supply channels through which the lean-side mixture is supplied to the two lean-side flame hole rows 34, 34. In addition, the tubular part 36 serves as a mixing chamber and as an introduction channel (i.e., a lean-side mixture introduction channel) for fuel gas and air supplied from the first supply port 31. The third plate member 6 constitutes a formation member for partition formation of a first supply channel (to be hereinafter described) and the downstream side of the lean-side mixture introduction channel is halved (divided into two parts) by the third plate members 6, 6, whereby two lean-side mixture supply channels, i.e., the inner spaces 37, 37, are formed by partition.

In addition, as to the rich-side mixture, fuel gas and air supplied to the second supply port 32 on the upstream side are mixed into a rich-side mixture in a tubular part 38. This rich-side mixture is subjected to further mixing when being guided to a close end 381 situated at the rear (back), i.e., on the downstream side, through the tubular part 38 (see also FIG. 13). And, this rich-side mixture is supplied to the central rich-side burner part 3*a* and to the outer rich-side burner parts 3*c* on both horizontal sides. In other words, the lower end part 60*a* on the front end side of the central rich-side burner part 3*a* is inserted from above into the inside of the tubular part 38 so as to be disposed as a projecting part which projects in a suspended state in the tubular part 38 (see also FIG. 10 or FIG. 14). In the projecting part (i.e., the lower end part 60*a*), the first communication holes 61, 61 are opened near the upper side (section) of the mixing chamber which is an inner space of the tubular part 38, whereby the mixing chamber and the inner space 62 of the central rich-side burner part 3*a* are brought into fluid communication with each other. This arrangement makes it possible that the supply of rich-side mixture in the tubular part 38 is provided to the rich-side flame hole row 33 through the first communication holes 61, 61 and the inner space 62.

Figure 11:
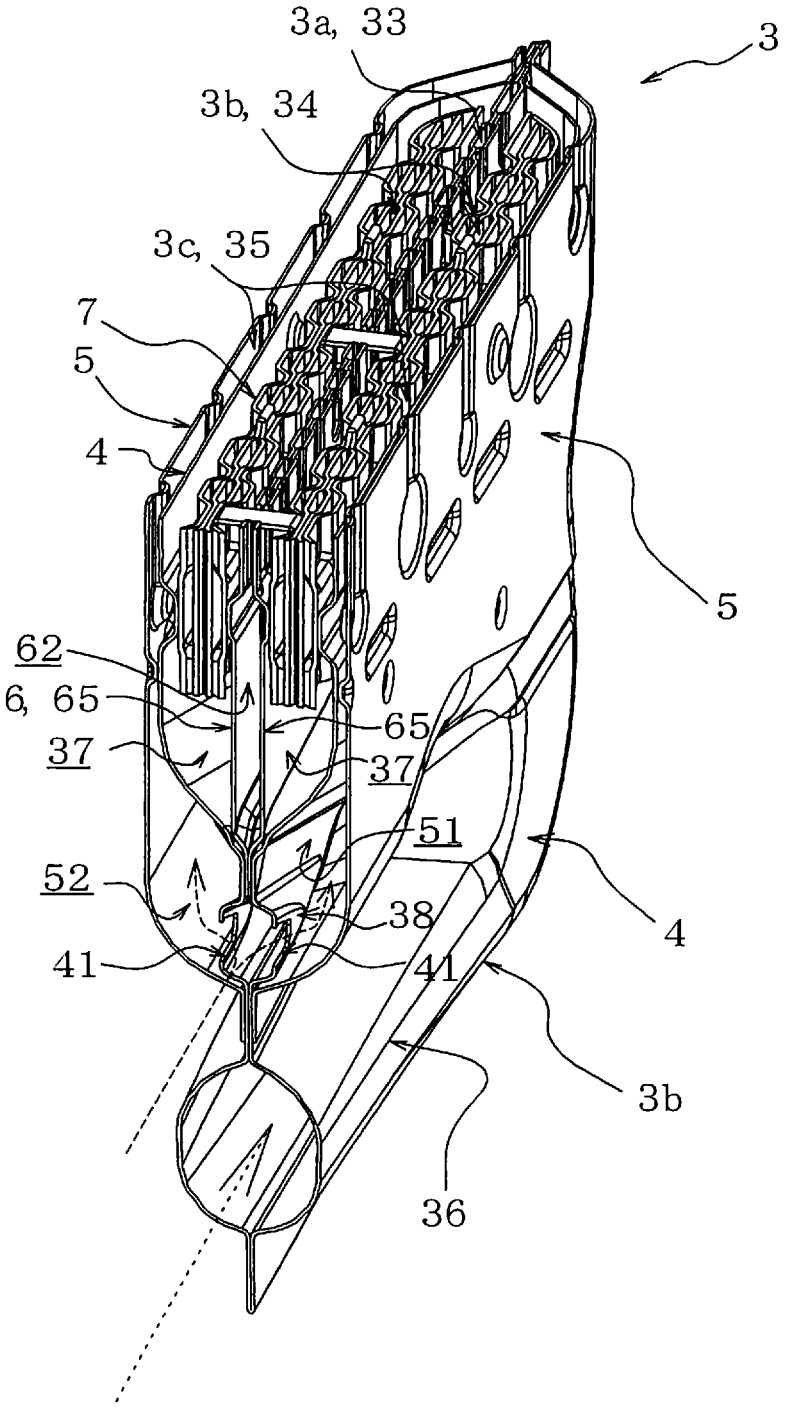
FIG. 11 is a partial perspective view of the rich-lean combustion burner when cut at a position corresponding to line C-C of FIG. 9.
Figure 12:
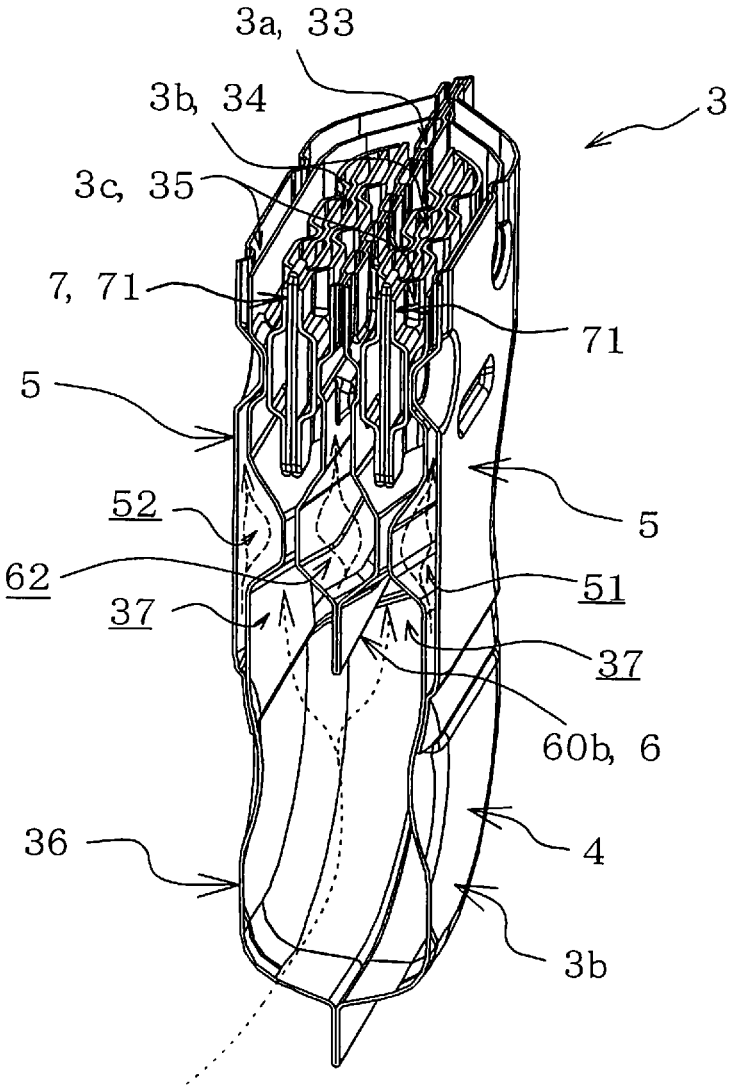
FIG. 12 is a partial perspective view of the rich-lean combustion burner when cut at a position corresponding to line D-D of FIG. 9.
Figure 13:
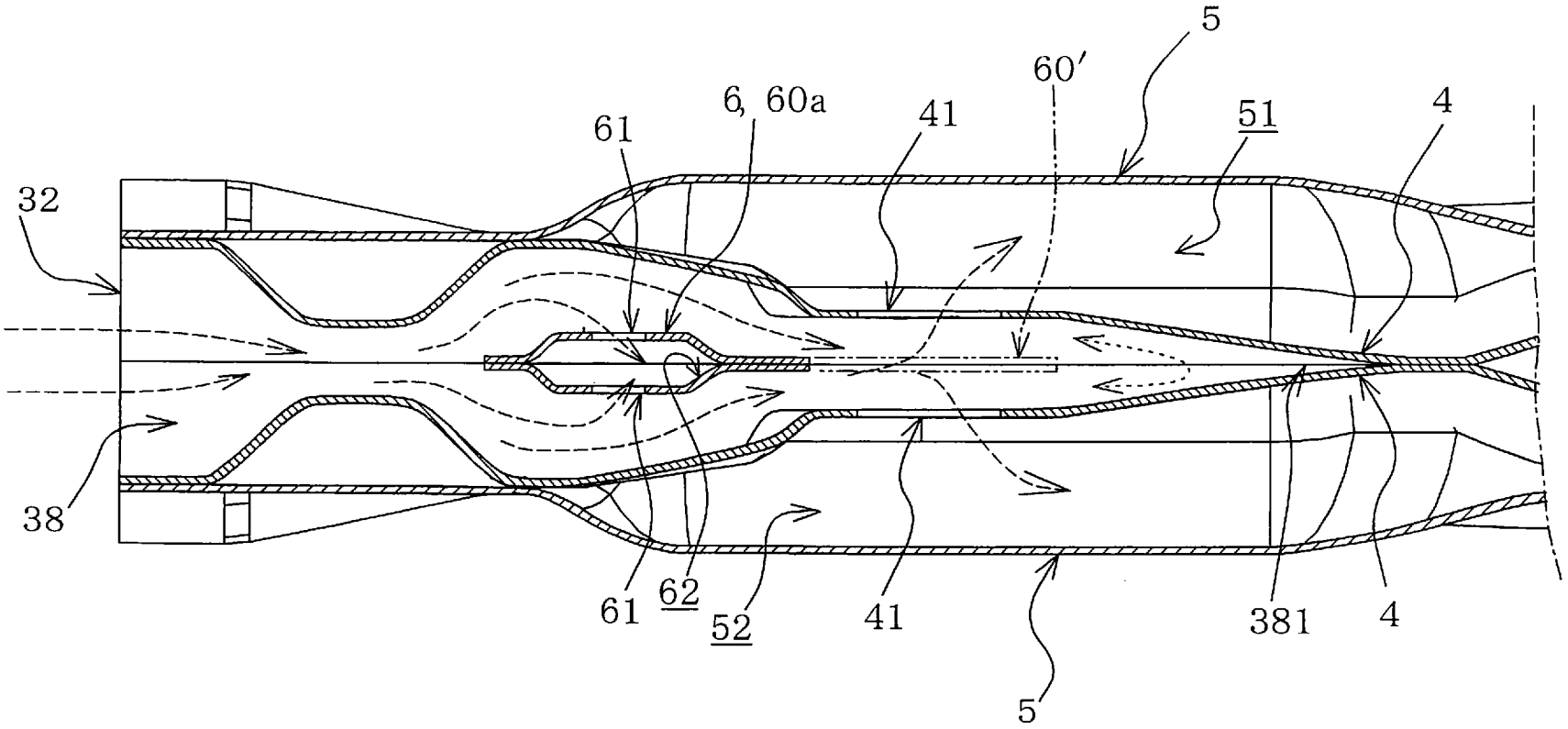
FIG. 13 is a partially enlarged cross-sectional illustration diagram showing a state taken along line E-E of FIG. 9.
Figure 14:
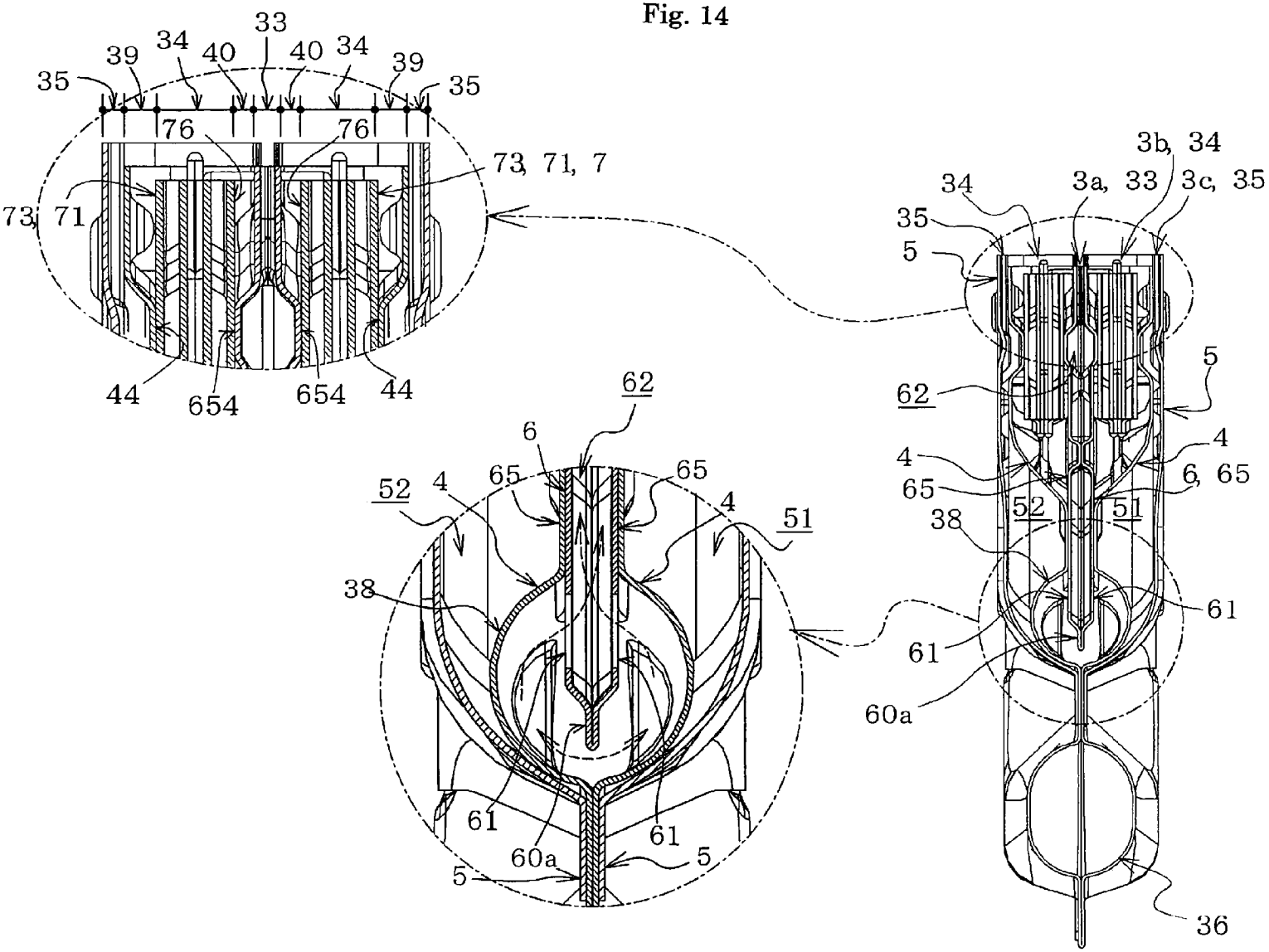
FIG. 14 is an enlarged cross-sectional illustration diagram of the rich-lean combustion burner when cut at a position corresponding to line B-B of FIG. 9.

In addition, on the side downstream of where both the first communication holes 61, 61 are opened (i.e., on the side of the closed end 381), a second communication hole 41 and a third communication hole 41 are formed respectively through the one pair of the first plate members 4, 4 constituting the tubular part 38 (see also FIG. 11 or FIG. 13). And, by the second communication hole 41 on one side (on the right-hand side in FIG. 11 and the upper side in FIG. 13), the mixing chamber of the tubular part 38 is brought into fluid communication with an inner space 51 between the first plate member 4 on one side and the second plate member 5 on the same side. On the other hand, by the third communication hole 41 on the other side (on the left-hand side in FIG. 11 and the lower side in FIG. 13), the mixing chamber in the tubular part 38 is brought into fluid communication with an inner space 52 between the first plate member 4 on the other side and the second plate member 5 on the same side. As a result of such an arrangement, the rich-side mixture present in the tubular part 38 is supplied, through the second communication hole 41 and the inner space 51, to the rich-side flame hole row 35 on the one side, while on the other hand the rich-side mixture present in the tubular part 38 is likewise supplied, through the third communication hole 41 and the inner space 52, to the rich-side flame hole row 35 on the other side. In addition, it is set that the second and the third communication holes 41, 41 are opened in opposing relation to each other in the lateral direction at a position facing in the direction of the notched concave part 60*c* of the third plate member 6 (see FIG. 9), whereby the second and the third communication holes 41, 41 in a paired configuration are opened in opposing relation to each other across a space in the tubular part 38 without any obstruction in between in the lateral direction (in the width direction), as shown in FIG. 11 or FIG. 13.

In addition, the tubular part 38 forms not only a mixing chamber for mixing of fuel gas and air which are supplied form the second supply port 32, but also it forms a rich-side mixture introduction channel through which the rich-side mixture mixed is introduced. On the other hand, the internal spaces 51, 51, 62 serve to form rich-side mixture supply channels for providing the supply of rich-side mixture to their corresponding ones of the rich-side flame hole rows 35, 33, 35. In other words, the inner space 51 in fluid communication with the second communication hole 41 constitutes a second rich-side mixture supply channel. The inner space 52 in fluid communication with the third communication hole 41 constitutes a third rich-side mixture supply channel. And, the inner space 62 in fluid communication with the first communication holes 61, 61 constitutes a first rich-side mixture supply channel.

Figure 15:
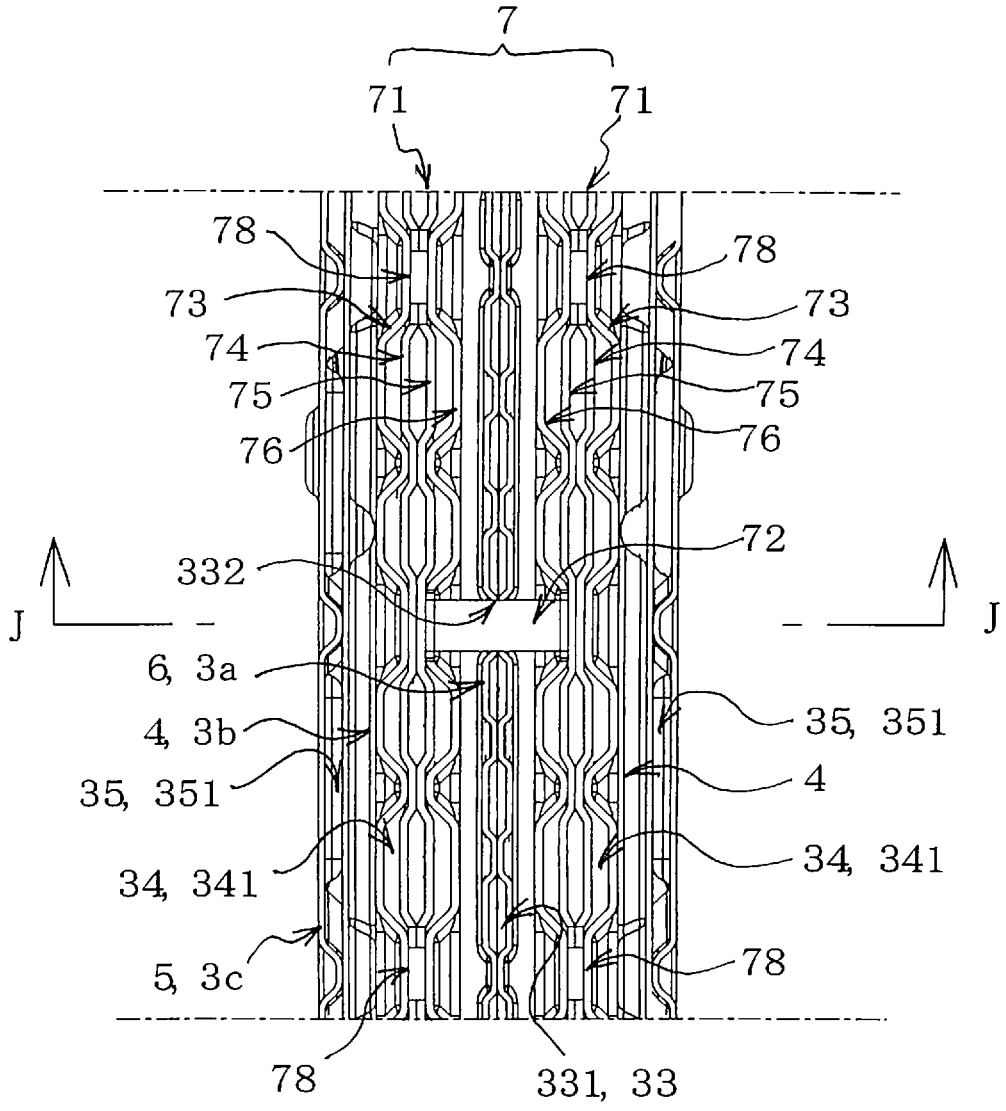
FIG. 15 is a partially enlarged top plan view of a section of the rich-lean combustion burner including a bridge formation part.
Figure 16:
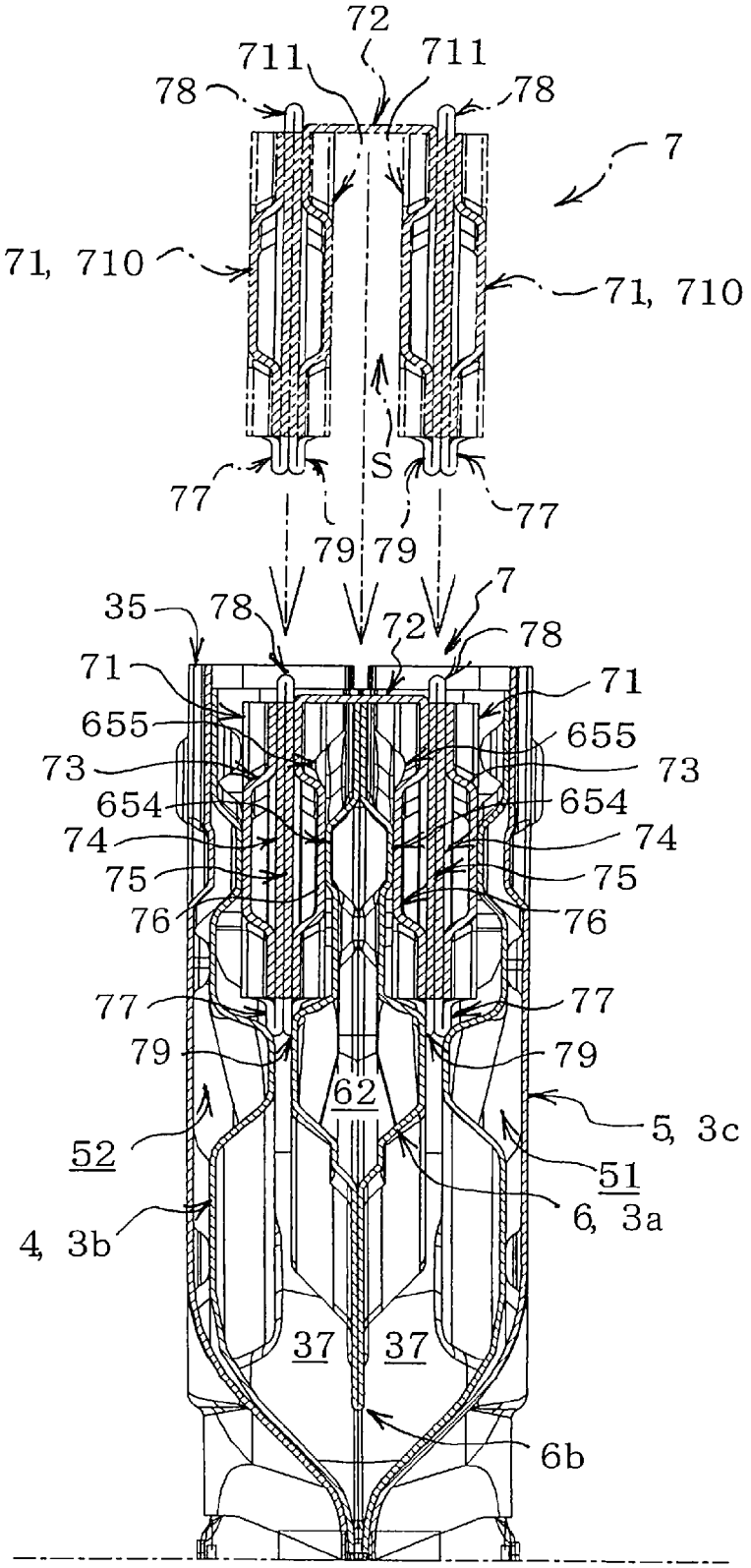
FIG. 16 is a cross-sectional illustration diagram in line J-J of FIG. 15.

Next, referring to FIGS. 15 and 16, a detailed description will be given regarding the flame hole formation member 7. The flame hole formation member 7 is formed as described above. That is, in the flame hole formation member 7, a pair of flame hole formation parts 71, 71 each forming a respective lean-side flame hole row 34 are connected in a bridge manner so as to be integral with each other at their upper ends by at least one or more bridge formation parts 72 (two bridge formation parts 72, 72 are shown in an example in the figure). As a result of this arrangement, the flame hole formation member 7 is formed so that its shape when viewed from side or its transverse cross-sectional view is in the form of a gate which has a clearance gap S (see FIG. 16) with a predetermined inner width between the flame hole formation parts 71, 71 and which is opened downward. Each flame hole formation part 71 is formed as follows. That is, at least two strip-like plate parts (four strip-like plate parts 73, 74, 75, 76 in an example in the figure) each formed into a predetermined corrugated shape by stamping formation are placed one upon the other so that according to the corrugated shapes, rich-side mixture channels are formed by partition between the surfaces of the strip-like plate parts in opposing relation to each other, wherein the rich-side flame holes 341 (represented only in FIG. 15) are opened in the upper end surface. The strip-like plate parts 73, 74, 75, 76 are strip-like distributing plates.

It is set that the inner width of the clearance gap S of FIG. 16 (i.e., the inner width between inner surfaces 711, 711 of the flame hole formation parts 71, 71) agrees with the lateral width dimension of the central rich-side burner part 3*a* formed by the third plate member 6 (more specifically, the widthwise dimension of protruding parts 654, 654 on both sides, the description of which will be given later) while on the other hand, it is set that the outer width between outer surfaces 710, 710 of the flame hole formation parts 71, 71 on both sides agrees with the lateral width of the first plate members 4, 4 (i.e., the distance between their inner surfaces). Owing to this arrangement, when the flame hole formation parts 71, 71 of the flame hole formation member 7 are inserted and mounted, from above, into spaces between the third plate member 6 and each first plate member 4, the outermost surface 710 of each flame hole formation part 71 (i.e., the outer surface of the distributing plate 73) is brought into close contact with the inner surface of the first plate member 4 (i.e., a protruding part 44 which will be described later), while on the other hand the innermost surface 711 of each flame hole formation part 71 (i.e., the outer surface of the distributing plate 76) is brought into close contact with the outer surface of the third plate member 6 (i.e., a protruding part 654 which will be described later), thereby providing a metal seal so that the mixture will not pass through therebetween and in addition, ensuring that the pair of the flame hole formation parts 71, 71 are positioned symmetrically relative to the lateral direction across the third plate member 6 so that they are assembled accurately to the third plate member 6 and to the first plate members 4, 4 without fail.

In this regard, a further detailed description will be given. As shown in FIG. 16, the third plate member 6 is provided, in the outer surface thereof near the upper end of each plate part 65, with a rib-shaped protruding part 654 projecting outward in the lateral direction (see also FIG. 4 and FIG. 5). The protruding part 654 is formed so as to extend for the entire longitudinal length. And, the innermost surface 711 of each flame hole formation part 71 is brought into close contact with the protruding part 654. On the other hand, the first plate member 4 is also provided with a rib-shaped protruding part 44 projecting inward in the lateral direction 9 (see also FIG. 4 and FIG. 5). The protruding part 44 is formed so as to extend for the entire longitudinal length. And the outermost surface 710 of each flame hole formation part 71 is brought into close contact with the protruding part 44. Owing to such arrangement, the aforesaid metal seal is accomplished. In addition, non-emission zones 39, 40, 40, 39, from which no mixtures are emitted and which extend for the entire longitudinal length in the form of a strip having a slight lateral width corresponding to the length for which the protruding parts 44, 654, 654, 44 each project, are formed between the lean-side flames produced in each lean-side flame hole row 34 (see FIG. 14) and the rich-side flames produced respectively in the central rich-side flame hole row 33 and each outer rich-side flame hole row 35 between which is sandwiched each lean-side flame hole row 34.

Additionally, the bridge formation parts 72, 72 of the flame hole formation member 7 are assembled such that from above, the bridge formation parts 72, 72 are mounted astride of and brought into abutment with the upper end edge of the third plate member 6 where the central rich-side flame hole row 3 is formed, thereby ensuring that the pair of the flame hole formation parts 71, 71 are assembled in place relative to the vertical direction. In this regard, the present embodiment employs such a manner that by abutment of the bridge formation parts 72, 72 with the third plate member 6, positioning errors or displacements not only relative to the vertical direction but also relative to the longitudinal direction are prevented from taking place, as will be described hereinafter. That is, as shown in detail in FIG. 17, the central rich-side flame hole row 33 of the third plate member 3 is provided, at its longitudinal positions corresponding to the longitudinal formation positions of the bridge formation parts 72, 72 of the flame hole formation member 7, with the engagement grooves 332 (see also FIG. 4) each having a longitudinal length corresponding to the strip width of the bridge formation part 72 and a predetermined depth. And by fitting of the bridge formation part 72 into the engagement groove 332 from above, it is ensured that the pair of the flame hole formation parts 71, 71 are assembled, in place relative to the longitudinal direction, to the third plate member 6 and the first plate members 4, 4 while being held without any displacement relative to the longitudinal direction. In addition, the first plate members 4, 4 may be assembled in either one of the following approaches. One approach is that after assembly of the third plate member 6 to the first plate members 4, 4, the flame hole formation member 7 is assembled from above. The other approach is that the flame hole formation member 7 is assembled in advance to the third plate member 6 and then both of them are assembled to the first plate members 4, 4.

Here, it is set that the depth of the engagement groove 332 is equal to or in excess of the thickness of the bridge formation part 72. And it is arranged that in a state of the bridge formation part 72 being fitted into the engagement groove 332, the upper surface of the bridge formation part 72 lies in flush with or lower than each of the rich-side flame holes 331, 351 of the rich-side flame hole rows 33, 35. This arrangement makes it possible to prevent the bridge formation part 72 itself from undergoing burn phenomenon during combustion operation of the rich-lean combustion burner, whereby it is possible to avoid worsening of the retainability of flames in the rich-lean combustion state due to burn phenomenon. In addition, although not shown in the figure, the bridge formation part 72 is formed such that its upper surface underlies the upper end surface of each flame hole formation part 71 (i.e., the upper end surface of each rich-side flame hole 331 of the central rich-side flame hole row 33 formed by the upper end surface of each strip-shaped plate part 73-76), thereby further ensuring that the bridge formation part 72 itself is prevented from undergoing burning phenomenon taking place during combustion operation of the rich-lean combustion burner.

Furthermore, formed near the upper end of each plate part 65 of the third plate member 6 are an appropriate number of projection parts (two projecting parts 655, 655). The projecting parts 655, 655 each project outward in the lateral direction, as shown in FIG. 4 or FIG. 5. And, each flame hole formation part 71 of the flame hole formation member 7 is inserted and mounted from above and then the bridge formation parts 72, 72 are fitted into the engagement grooves 332, 332, in which state the projecting parts 655, 655 (see FIG. 16) are fitted into concave parts formed in the innermost surface 711 of each flame hole formation part 71 so as to serve to prevent each flame hole formation part 71 from coming loose in the upper direction.

Figure 18:
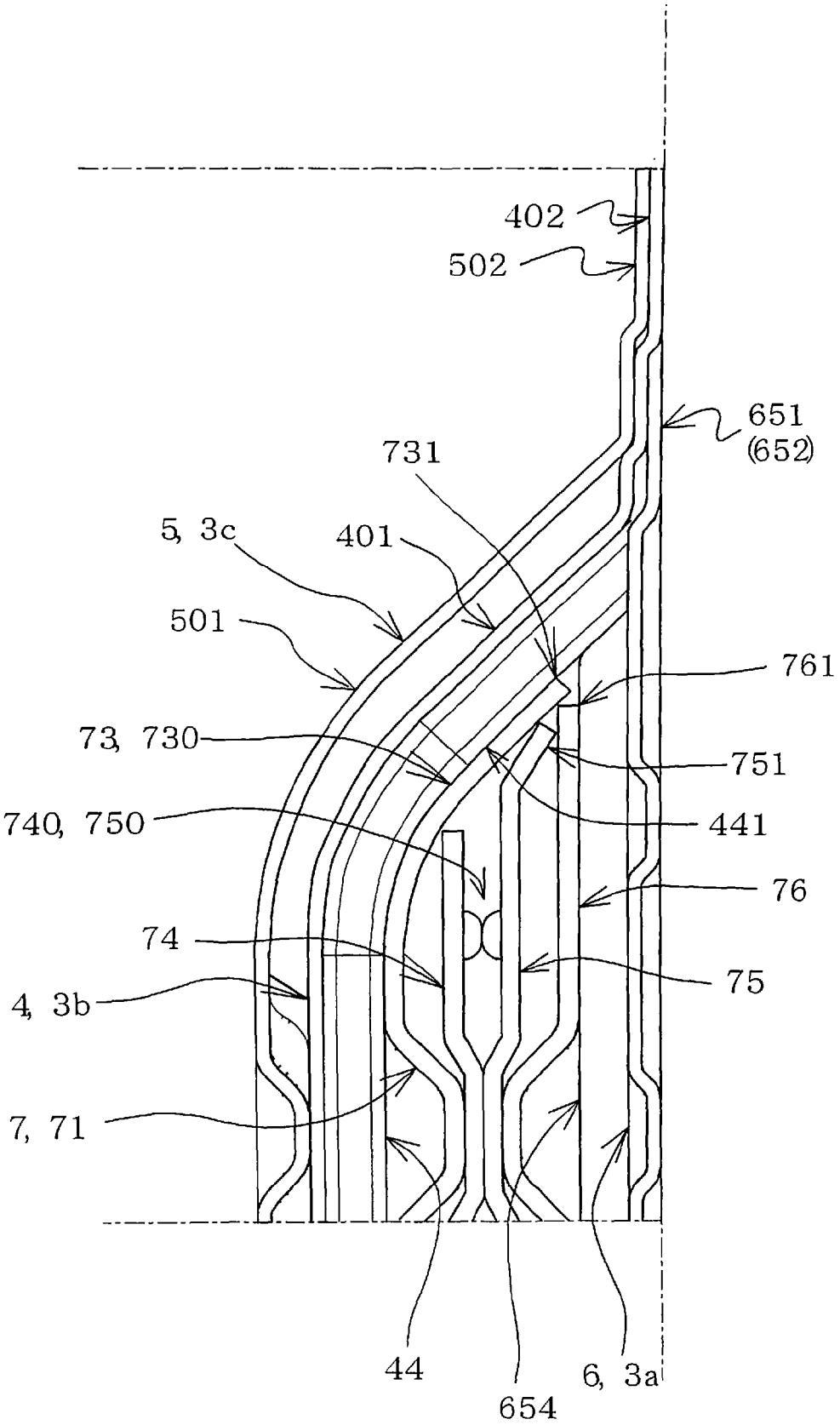
FIG. 18 is a partially enlarged view of FIG. 3(*b*)

On the other hand, as a structure for use in the longitudinal end part of each flame hole formation part 71 of the flame hole formation member 7, the following structure is employed. In other words, as shown in FIG. 18, a longitudinal end part 401 of the first plate member 4 and a longitudinal end part 501 of the second plate member 5 smoothly curve towards an end edge 651 (652) of the third plate member 6, and are joined together at their lateral ends. This forms by partition spaces, to which lean-side mixture is supplied and into which each flame hole formation part 71 is fitted, between the third plate member 4 and the third plate member 6, more specifically, between the protruding part 44 of the first plate member 4 and the protruding part 654 of the third plate member 6. And, the longitudinal end part of the outermost strip-like plate part (distributing plate) 73 is made convex outward to curve towards the innermost strip-like plate part (distributing plate) 76 so as to serve as a curved part 730. And, a leading end 731 of the curved part 730 is positioned so as to overlap, from outside, a longitudinal leading end 761 of the innermost strip-like plate part 76. To sum up, in the longitudinal end part, the flame hole formation part 71 is formed such that the innermost strip-like plate part 76 is linearly extended up to the longitudinal leading end 761 while on the other hand the outermost strip-like plate part 73 has the curved part 730 and its leading end 731 is placed in a state of being overlapping the leading end 761 of the strip-like plate part 76. In addition, it is arranged that a leading end 751 of the strip-like plate part (distributing plate) 75 which lies adjacent to the innermost strip-like plate part 76 is curved towards the innermost strip-like plate part 76 for a predetermined curvature amount. Such a curvature amount may be determined to such an extent that even when an external force is exerted so as to cause the innermost strip-like plate part 76 to relatively approach its adjoining strip-like plate part 75, the size of gap clearance between the strip-like plate part 76 and the strip-like plate part 75 will not become too small. Accordingly, it suffices if the foregoing curvature amount is determined to such an extent that the leading end part 751 comes into contact with the innermost strip-like plate part 76 or that the leading end part 751 is positioned in the vicinity of the innermost strip-like plate part 76 situated in its original position. Additionally, note here that sign 740 in FIG. 18 denotes a convex part which projects form the strip-like plate part (distributing plate) 74 towards its adjoining strip-like plate part 75, and sign 750 denotes a convex part which projects from the strip-like plate part 75 towards its adjoining strip-like plate part 74. By abutment between the convex parts 740 and 750 on both sides, the opposing interval between the two adjoining strip-like plate parts 74, 75 is prevented from becoming narrowed to be less than the predetermined amount.

By employing such a configuration, the following operation/advantageous working effects will be accomplished. That is, even if process errors, assembly positioning errors or other like errors occur, it is still possible to, while accomplishing easy and reliable assembly particularly on the longitudinal end, enable the outermost surface of the flame hole formation part 71 to remain in close contact with its opposing protruding part 44 of the first plate member 4. For example, even if the inner width (Y) between the protruding part 44 of the first plate member 4 and the protruding part 654 of the third plate member 6 becomes narrowed to slightly fall below the original size (for example, 0.1 mm) due to process errors as pointed out above, this is absorbed because the curved part 730 is pushed by the protruding part 44 to undergo elastic deformation so as to extend towards the leading end, whereby the curved part 730 is able to remain in close contact with the protruding part 44. In addition, in this case, even if a thrust power acts on and causes the innermost strip-like plate part 76 to approach its adjoining strip-like plate part 75, the curved leading end 751 of the adjoining strip-like plate part 75 comes into contact with the strip-like plate part 76, thereby making it possible to secure and maintain a predetermined clearance amount set for lean-side flame holes.

On the other hand, even if the inner width Y becomes widened to slightly exceed the original size (for example, 0.1 mm), the curved part 730 undergoes elastic deformation and follows, while remaining in close contact with the protruding part 44, the protruding part 44. In this case, in order to enhance the followability of the curved part 730, the curved part 730 is formed such that its original round shape is made larger than the original round shape of the protruding part 44 so as to make spring-back force available. As has been described above, particularly in the longitudinal end at which close contactability may be diminished, it is positively ensured that the flame hole formation part 71 used to form the lean-side flame hole row 34 is maintained in close contact with two plate members, between which is sandwiched the flame hole formation part 71, namely the third plate member 6 on the side of the central rich-side flame hole row 33 and the first plate member 4 on the outer side rich-side flame hole row 35, thereby making it possible to eliminating, without fail, the possibility that the flame retainability may worsen due to leakage of the rich-side mixture to the non-emission zones 39, 40.

Figure 19:
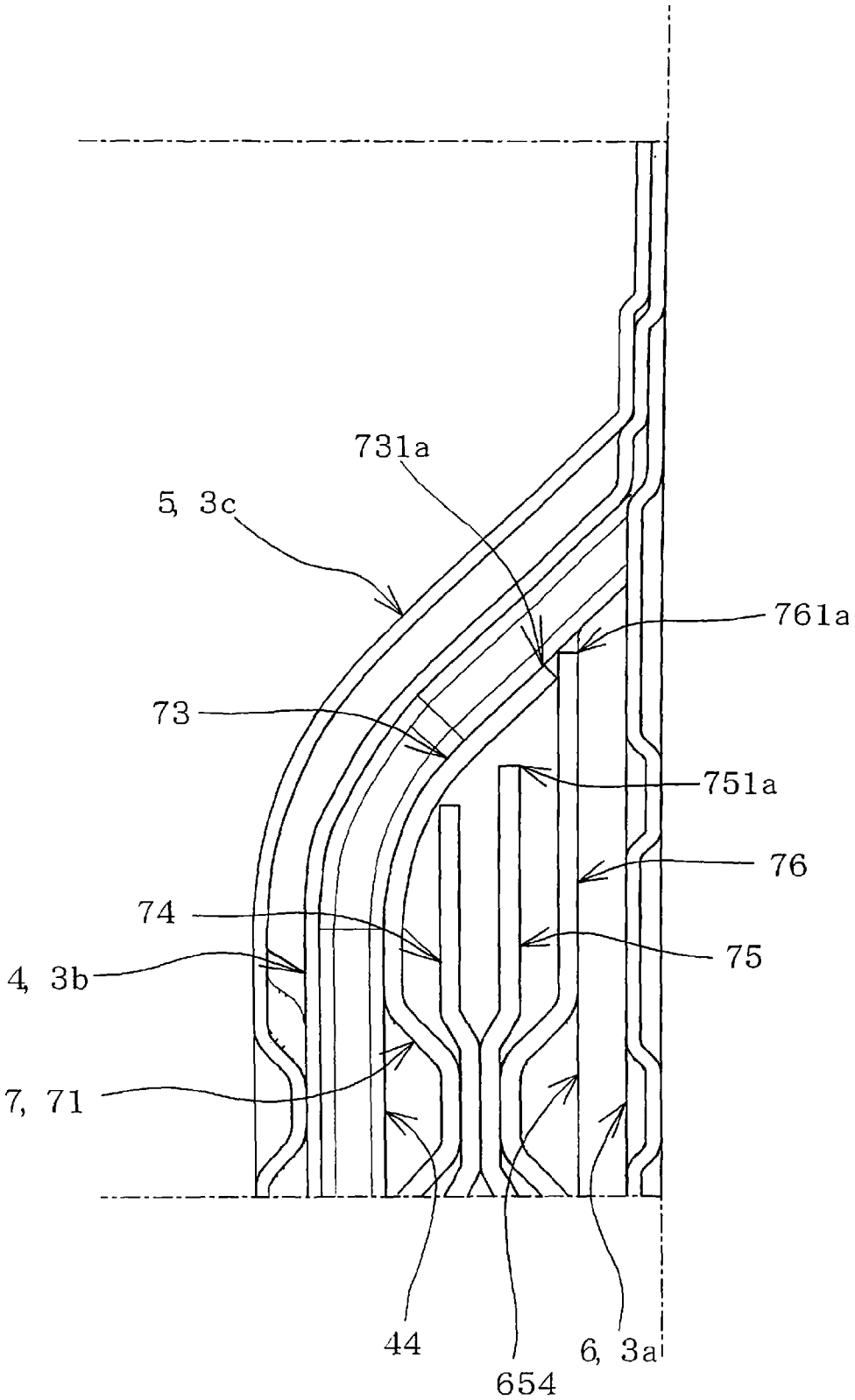
FIG. 19 is a corresponding view to FIG. 18 showing a structure example with which an embodiment according to the present invention is compared.

The operation/advantageous working effects of the foregoing embodiment will be compared with a comparative example shown in FIG. 19. For the case of the comparative example of FIG. 19, a leading end 731*a* of the outermost strip-like plate part 73 is disposed so as to strike against a leading end 761*a* of the innermost strip-like plate part 76. For the case of such an arrangement, if the inner width Y between the protruding part 44 and the protruding part 654 becomes, for example, narrower than the original size, this makes it impossible for the leading end 731*a* of the outermost strip-like plate part 73 to undergo elastic deformation because it is striking against the leading end 761*a* of the innermost strip-like plate part 76. Not only in the case where the leading end 731*a* of the outermost strip-like plate part 73 does not strike against the leading end 761*a*, but also in the case where the leading end 731*a* of the outermost strip-like plate part 73 is disposed at a position in the vicinity of the leading end 761 short of striking thereagainst, elastic deformation for the absorption of process errors or other like errors is suppressed. This results in the possibility that even insertion and mounting into the space having the inner width Y for assembly may become impossible.

Figure 20:
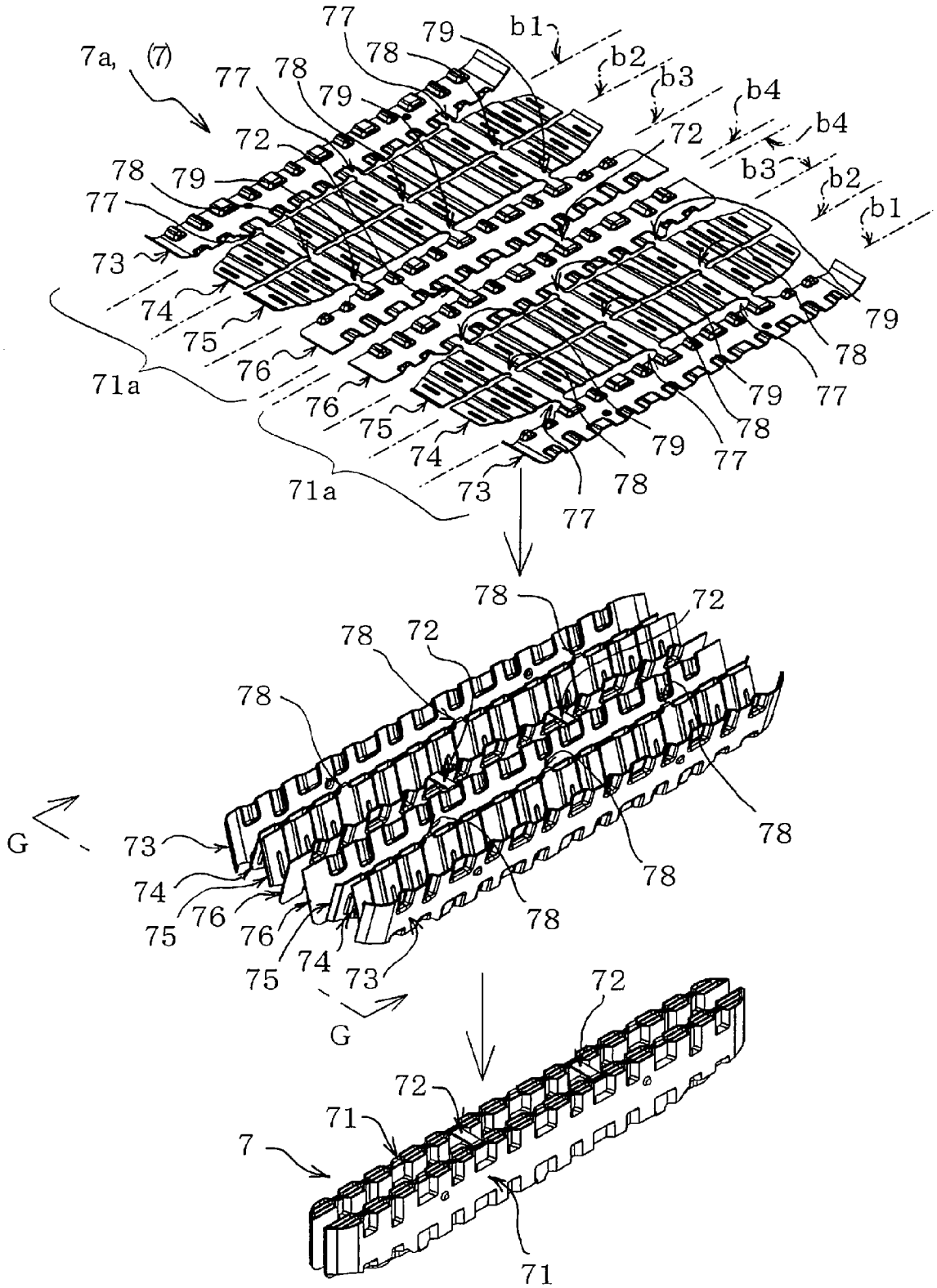
FIG. 20 is a reference diagram showing, in perspective manner, procedures for manufacturing the flame hole formation member of FIG. 4 or FIG. 5 from a metallic material in the form of a single sheet.
Figure 21:
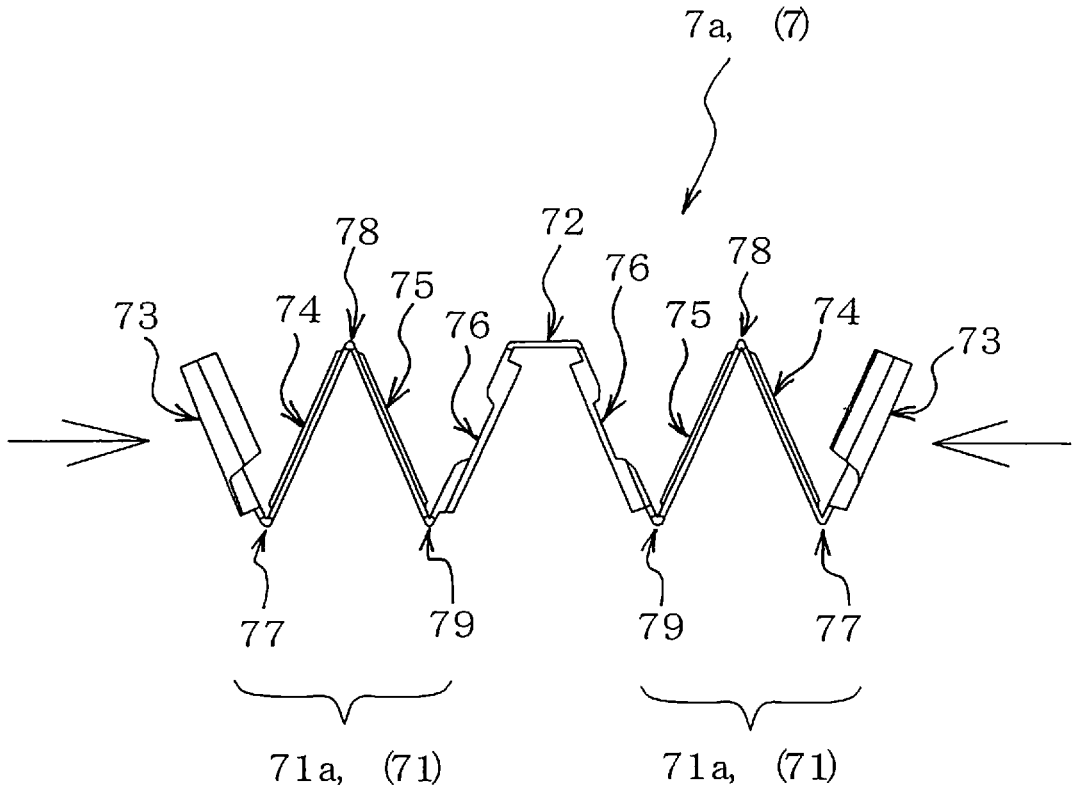
FIG. 21 is a view on arrow G-G in FIG. 20.
Figure 22:
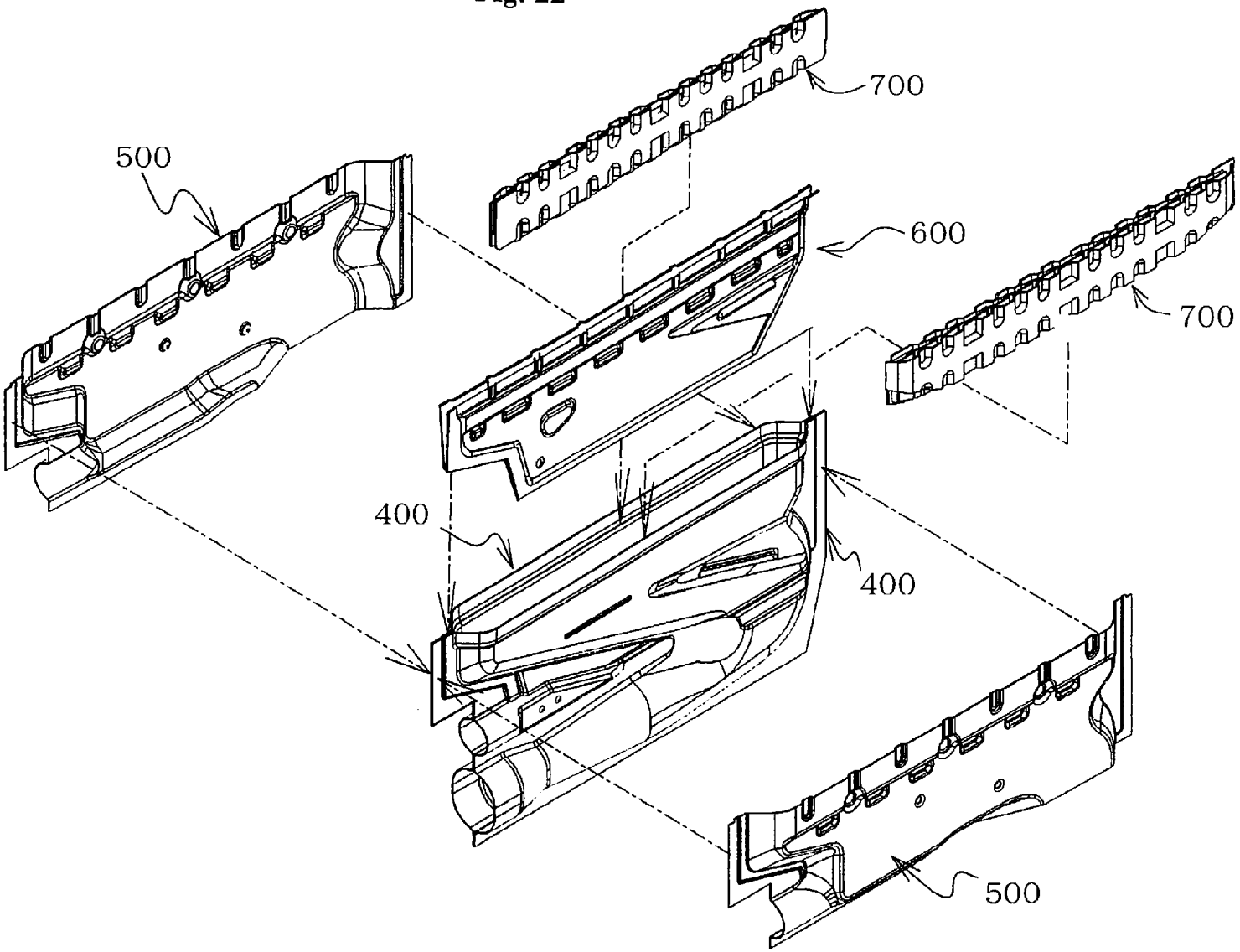
FIG. 22 is a corresponding view to FIG. 4 illustrating an example of an assembly for explaining a problem to be solved by the present invention.
Figure 23:
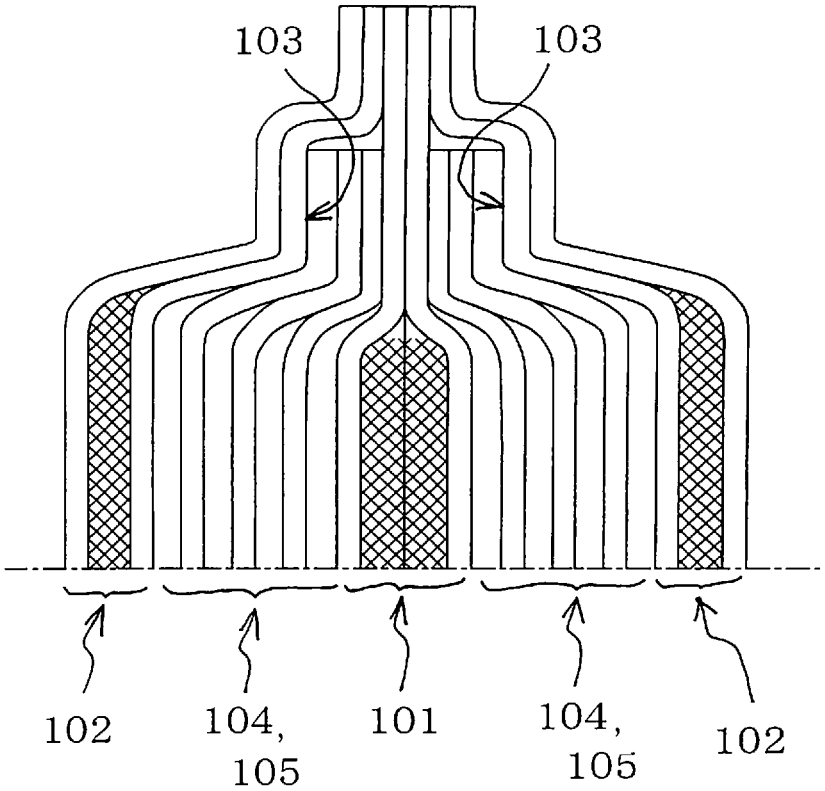
FIG. 23 is a top plan illustration view depicting an example of the assembly of a longitudinal end for explaining a problem to be solved by the present invention.

Next, a description will be given regarding the method of manufacture of the flame hole formation member 7 having the above-described configuration. Referring to FIG. 20, there is shown an example of the method of manufacture of the flame hole formation member 7. In this example, there is provided a sheet of metallic material. The metallic material sheet is subjected to a stamping process to perform a formation step of forming predetermined concave/convex shapes and a cutting step whereby there is formed a flame hole formation material 7*a* in a developed state. Then, the flame hole formation material 7*a* is folded into an accordion shape to form a flame hole formation member 7. Stated in another way, formation parts 71*a*, 71*a*, which serve as the flame hole formation parts 71, 71 and which are situated on both sides in opposing relation to each other across the bridge formation parts 72, 72, are arranged symmetrically with each other and integrally connected with each other by the bridge formation parts 72, 72. Each formation part 71*a* is formed such that the strip-like plate parts 73-76 having predetermined concave/convex shapes are integrally connected with each other by an appropriate number of connecting parts 77, 78, 79 each formed into a thin strip shape. And, each of the formation parts 71*a*, 71*a* on both sides which are arranged opposite to each other across the bridge formation parts 72, 71 is shaped like an accordion by alternate folding at positions of predetermined fold lines b1, b2, b3, b4 extending in parallel with each other (see also FIG. 21). Then, the adjoining ones of the strip-like plate parts 73, 74, 74, 75, 75, 76 are joined together to form a flame hole formation member 7.

And, for the case of the foregoing rich-leans combustion burner 3, the two lean-side flame hole rows 34, 34 are each sandwiched, from both sides, by either the rich-side flame hole rows 35, 33 or the rich-side flame hole rows 33, 35, whereby each lean-side flame produced in both the lean-side flame hole rows 34, 34 is enclosed from both sides by rich-side flames. That is, it is possible that the flame configuration in the lateral direction is made to have a flame arrangement sequence: RICH-LEAN-RICH-LEAN-RICH. Owing to this, even in the case where there are provided two rows of lean-side flame holes 34, 34 to increase lean-side flame hole row area, it is still possible to prevent lean-side flames from increasing in flame length, whereby the height of the combustion chamber 22 (see FIG. 1) can be held short. And, by increasing lean-side flame hole area (ratio) while holding the height of the combustion chamber short, it becomes possible to achieve further NOx reduction or further stabilized combustion. In addition, as compared to the case where a single rich-lean combustion burner is configured such that a single row of lean-side flame holes is sandwiched between two rows of rich-side flame holes from both sides, it becomes possible to efficiently achieve better weight saving of the rich-lean combustion burner if the same lean-side flame hole area is to be realized. Furthermore, it is possible that the rich-side mixture, introduced into the tubular part 38 from a single fuel gas/air supply port (the second supply port 32) for mixing of fuel gas and air, is split into flow lines for accomplishing branch supply of the rich-side mixture, through the first communication holes 61, 61 of the central rich-side burner part 3*a* which are opened in fluid communication respectively with regions on the closed end side of the tubular 38, through the second communication hole 41 of the outer rich-side burner part 35 on one side, and through the third communication hole 41 of the outer rich-side burner part 35 on the other side, to their corresponding inner spaces 62, 51, 52. Owing to this, even in the case of forming three rich-side flame hole rows 35, 33, 35 respectively in the middle, on one outside and on the other outside, the flow of rich-side mixture can be smoothly and certainly split by a simple structure into flow lines for supplying of the rich-side mixture to the rich-side flame hole rows 35, 33, 35. The arrangement described above makes it possible that the central rich-side burner 3*a* is made relatively thin in its lateral thickness whereby there is realized a rich-lean combustion burner with a flame arrangement sequence of RICH-LEAN-RICH-LEAN-RICH and compact in size.

Furthermore, in addition to the foregoing assumed advantageous effects, based on the configuration of the flame hole formation member 7 and the assembly structure thereof; the following working effects are provided by the present embodiment. That is, in the present embodiment, the flame hole formation member 7 is employed which is formed in advance by integral connection of the pair of the flame hole formation parts 71, 71 with the aid of the bridge formation parts 72, 72. Then, the flame hole formation member 7 thus formed is assembled to the third plate member 6 and the first plate members 4.4. Accordingly, when compared to the case where the flame hole formation parts 71, 71 are formed individually from each other (i.e., separates members) and their assembly to the third plate member 6 and to the first plate members 4, 4 is also carried out independently (see FIG. 20 as an exemplary case), it is possible to eliminate errors occurring at the time of assembly such as "upside down" assembly and wrong-surface orientation to the third plate member 6, thereby making it possible to prevent assembly workability from decrease. Furthermore, it is possible to assemble a pair of flame hole formation parts 71, 71 by carrying out a single assembly operation, whereby the aforesaid assembly workability can be improved to a further extent.

In addition, by the use of the flame hole formation member 7 formed by pre-integration of the pair of the flame hole formation parts 71, 71 with the aid of the bridge formation parts 72, 72 extending in the lateral direction, it is ensured that the opposing interval between the pair of the flame hole formation parts 71, 71 is maintained in advance in such a state that they are spaced from each other, with a predetermined opposing interval in between. This makes it possible that the state after completion of the assembly to the third plate member 6 and to the first plate members 4,4 is also equalized to a further extent, thereby making it possible that close contactability between each flame hole formation member 71, and the third and the first plate members 6, 4 by which the flame hole formation member 71 is sandwiched is equalized and ensured to a further extent. This makes it possible to secure sealability (metal seal) for prevention of the leakage of mixtures or the like, whereby good flame retainability will be maintained during rich-lean combustion. In addition, it is possible to provide facilitation and assurance of the positioning in particular in the lateral direction (width direction).

Furthermore, the bridge formation parts 72, 72 are brought into abutment with the third plate member 6 so as to sit astride it, whereby it is ensured that the pair of the lean-side flame hole rows 34, 34 formed by the flame hole formation member 7 are located in place at their respective predetermined vertical positions with respect to the rich-side flame hole row 33 of the third plate member 6. In addition, each bridge formation part 72 is assembled by being fitted into the engagement groove 332 of the third plate member 6, thereby making it possible to not only facilitate and assure positioning operations in the longitudinal direction (front-to-back direction), but also it becomes possible to carry out assembly operations in such a state that ensures that misregistration in the longitudinal direction is prevented without fail. Therefore, even in the case of producing rich-lean combustion burners in large quantities, the flame hole formation member 7 composed of the pair of the flame hole formation parts 71, 71 each forming the lean-side flame hole row 34 is assembled correctly in place with respect to lateral direction (horizontal width direction), longitudinal direction (front-to-back direction) and vertical direction, in relative positional relation with respect to the other plate members including the third plate member 6 used to form the central rich-side flame hole row 33.

Other Embodiments

In the foregoing embodiment, the bridge formation parts 72 are arranged respectively at positions of the upper ends of the one pair of the flame hole formation parts 71, 71. This arrangement, however, should not be considered a limitation of the present invention. For example, instead of the bridge formation parts 72, 72 provided at the upper end positions, it may be arranged that the bridge formation parts 72, 72 are disposed respectively at positions of the longitudinal side ends of the pair of the bridge formation parts 72, 72.

In addition, the flame hole formation member 7 shown in the foregoing embodiment may be applied to a rich-lean combustion burner having a different configuration from the foregoing embodiment with the exclusion of the configuration relating to the flame hole formation member 7 as long as it is a rich-lean combustion burner including: a central rich-side flame hole row 33 composed of central rich-side flame holes 33; a pair of lean-side flame hole rows 34, 34 each composed of lean-side flame holes 341 and arranged such that they sandwich from both lateral sides the central rich-side flame hole row 33 therebetween; and outer rich-side flame hole rows 35, 35 each composed of outer flame holes 351 and arranged such that each lean-side flame hole row 34 is sandwiched therebetween from outside.

The flame hole formation part 71 may be formed by two strip-like plate parts (two distributing plates) disposed respectively on the outermost side and on the innermost side. In addition, what is meant by "it is arranged that the leading end 731 of the outermost strip-like plate part 73 is disposed so as to overlap the leading end 761 of the innermost strip-like plate part 76" includes, other than one exemplarily shown in the figure in which example it is arranged that the leading end 731 overlaps the leading end 761 and extends towards the longitudinal leading end, an arrangement that the leading end 731, although it is located at almost the same longitudinal position as the leading end 761, overlaps a corner of the leading end 761 so that even if the curved part 730 undergoes elastic deformation in the direction of the leading end, the leading end 731 is able to make relative displacement towards the longitudinal leading end without abutment with the leading end 761, i.e., an arrangement that the leading end 761 does not interfere with elastic deformation of the leading end 731 of the curved part 730.

Other than the flame hole formation member 7 which is formed using a flame hole formation material 7*a* in a developed state which is prepared by subjecting a sheet of a metallic material to a stamping process in which to perform a formation step of forming predetermined concave/convex shapes and a cutting step, the flame hole formation member 7 may be formed by assembling a plurality of separately-formed strip-like plate parts by means of spot welding or other like means.

What is claimed is:

1. A rich-lean combustion burner, comprising: a) central rich-side flame holes arranged in one row and extending in the longitudinal direction in the middle relative to the lateral direction, b) lean-side flame holes arranged in two rows sandwiching said central rich-side flame hole row therebetween from both sides relative to the lateral direction and c) outer rich-side flame holes arranged in two rows sandwiching said two lean-side flame hole rows on both sides therebetween from outside, wherein a flame hole formation member forms said lean-side flame holes of said two lean-side flame hole rows, said flame hole formation member being inserted and mounted from above in a formation member forming said central rich-side flame holes, and wherein said flame hole formation member comprises: i) a pair of flame hole formation parts forming said lean-side flame holes of each of said two lean-side flame hole rows and ii) at least one or more bridge formation parts connecting respective upper end portions or respective side end portions of said pair of said flame hole formation parts, and wherein said pair of said flame hole formation parts are held integrally with each other by said bridge formation part in such a state that said pair of said flame hole formation parts are oriented face-to-face with each other and spaced apart at an interval of a predetermined distance so as to sandwich therebetween said formation member forming said central rich-side flame holes from both sides relative to the lateral direction.

2. The rich-lean combustion burner as set forth in claim 1, wherein in the upper end area of said pair of said flame hole formation parts, sequential ones of a plurality of said bridge formation parts are spaced apart from one another in the longitudinal direction at intervals of a predetermined distance.

3. The rich-lean combustion burner as set forth in claim 2, wherein said bridge formation part abuts said formation member forming said central rich-side flame holes in such a state that said bridge formation part sits from above astride the upper end edge of said central rich-side flame hole formation member.

4. The rich-lean combustion burner as set forth in claim 2, wherein said bridge formation part is shaped as a strip-like plate extending in the lateral direction, wherein, an engagement groove is formed in the upper end edge of said formation member forming said central rich-side flame holes, said bridge formation part is fitted into the engagement groove, and wherein by fitting of said bridge formation part into said engagement groove, said flame hole formation member is connected in such a state that its movement in the longitudinal direction is controlled.

5. The rich-lean combustion burner as set forth in claim 2, wherein said bridge formation part has an upper surface which lies either in flush with or lower than the upper surface of said central rich-side flame holes.

6. The rich-lean combustion burner as set forth in claim 1, wherein said formation member forming said central rich-side flame holes is disposed, in the vicinity of its upper end, with a projecting part projecting outward in the lateral direction while, a concave part is formed in the innermost surface of said flame hole formation member, said projecting part is received into said concave part to thereby prevent said flame hole formation part from coming loose in the upward direction.

7. The rich-lean combustion burner as set forth in claim 1, wherein said flame hole formation member is formed from a flame hole formation material in the form of a developed sheet, said material sheet comprising at least two partially connected strip-like plate parts which forming said flame hole formation parts on both sides so that said flame hole formation parts are positioned in opposing relation to each other across said bridge formation part, and said flame hole formation material sheet bending at positions where said bridge formation parts and the strip-like plate parts are connected and said flame hole formation member is an integral construction.

8. The rich-lean combustion burner as set forth in claim 1, wherein each of said lean-side flame holes is formed by an assembled plurality of distributing plates so that clearance gaps are formed between ones of said plural distributing plates in opposing relation to each other, forming flow channels for lean-side mixture, and wherein the longitudinal end of the outermost one of said plural distributing plates curves outward so as to describe a convex curve in plan view so that the longitudinal leading end of said outermost distributing plate overlaps the longitudinal leading end of the innermost one of said plural distributing plates.

9. The rich-lean combustion burner as set forth in claim 8, wherein the longitudinal end of said outermost distributing plate has a material elasticity so that the longitudinal end of said outermost distributing plate elastically deforms to be in close contact with the inner surface of said formation member forming said outer rich-side flame holes.

10. The rich-lean combustion burner as set forth in claim 8, wherein the longitudinal end of another distributing plate adjacent to said innermost distributing plate is curved in the direction of said innermost distributing plate.

11. A combustion apparatus comprising a rich-lean combustion burner as set forth in any one of claims 1 through 10.

* * * * *